US012359422B2

(12) United States Patent
Hensen et al.

(10) Patent No.: US 12,359,422 B2
(45) **Date of Patent: *Jul. 15, 2025**

(54) COLUMN CAP

(71) Applicant: Simpson Srong-Tie Company Inc., Pleasanton, CA (US)

(72) Inventors: Sam Thomas Hensen, Pleasanton, CA (US); Emmet J Mielbrecht, Danville, CA (US); Timothy M. Stauffer, Pleasant Hill, CA (US); Jin-Jie Lin, Livermore, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/118,074

(22) Filed: Mar. 6, 2023

(65) Prior Publication Data

US 2023/0203802 A1 Jun. 29, 2023

Related U.S. Application Data

(62) Division of application No. 17/460,245, filed on Aug. 29, 2021, now Pat. No. 11,598,082, which is a (Continued)

(51) Int. Cl.
*E04B 1/26* (2006.01)

(52) U.S. Cl.
CPC ..... *E04B 1/2608* (2013.01)

(58) Field of Classification Search
CPC .... E04B 1/2604; E04B 1/2608; E04B 1/2612; E04B 1/2403; E04B 2001/2415; E04B 2001/2644
(Continued)

(56) References Cited

U.S. PATENT DOCUMENTS 784,218 A * 3/1905 Lane ..... E04B 1/2608 403/384
813,253 A * 2/1906 Sullivan ..... E04G 11/12 52/715
(Continued)

FOREIGN PATENT DOCUMENTS

CA 1285739 C * 7/1991 ..... E04B 1/0007
CA 2339672 A1 * 9/2002 ..... E04B 1/2608
(Continued)

OTHER PUBLICATIONS

"Kant-Sag Construction Hardware," Catalog, Jun. 1986, front and back covers and pp. 24-25, United Steel Products Company, Montgomery, MN.
(Continued)

*Primary Examiner* — Ryan D Kwiecinski
(74) *Attorney, Agent, or Firm* — Charles R. Cypher

(57) ABSTRACT

A column cap connector for mounting and securing a beam to a post of a building including a central web portion and upwardly extending walls disposed along longitudinal edges thereof, wherein a lower portion of the beam fits within the walls, downwardly extending legs formed from the seat and alternatively from the seat and the walls of the connector attach the connector to the post with projecting tabs attached to the seat to support the connector on the post.

13 Claims, 36 Drawing Sheets

Related U.S. Application Data division of application No. 16/396,610, filed on Apr. 26, 2019, now Pat. No. 11,105,085, which is a division of application No. 14/973,455, filed on Dec. 17, 2015, now Pat. No. 10,273,678.

(60) Provisional application No. 62/094,927, filed on Dec. 19, 2014.

(58) Field of Classification Search
USPC ..... 52/698, 702, 712, 715
See application file for complete search history.

(56) References Cited

U.S. PATENT DOCUMENTS 936,322 A * 10/1909 Jeffers ..... E04B 1/4171 52/715
963,585 A * 7/1910 Kimball ..... E06B 3/984 403/231
1,082,470 A * 12/1913 Phelan ..... E04B 1/2608 52/715
1,260,531 A * 3/1918 Fiala, Jr. ..... F16B 7/0493 403/399
1,423,991 A * 7/1922 Brooks ..... E04F 21/05 52/713
1,716,138 A * 6/1929 Johnson ..... F04B 47/026 59/8
1,848,085 A * 3/1932 Eisenschmidt ..... F16B 7/0493 D8/380
1,931,739 A * 10/1933 Rutten ..... B65D 90/08 52/715
1,945,925 A * 2/1934 Stiefel ..... E04B 1/2608 403/2
2,025,794 A * 12/1935 Venzie ..... E04B 2/58 52/715
2,084,758 A * 6/1937 Anderson ..... E06B 3/984 403/231
2,317,125 A * 4/1943 Barnett ..... F16B 9/058 403/190
2,413,362 A * 12/1946 Maxwell ..... E04B 1/2608 403/219
3,087,730 A 4/1963 Buckner
3,256,030 A * 6/1966 Banse ..... E04B 1/2608 52/712
3,422,585 A 1/1969 Dismukes
D215,727 S * 10/1969 Gilb ..... D8/373
3,667,786 A * 6/1972 Cooper ..... E04B 1/34347 65/32.4
3,889,441 A * 6/1975 Fortine ..... E04B 1/41 52/715
4,022,537 A * 5/1977 Gilb ..... F16B 9/058 52/715
D256,663 S * 9/1980 Gilb ..... D8/380
4,260,277 A * 4/1981 Daniels ..... F16B 9/052 52/370
4,313,688 A 2/1982 Daniels
D265,051 S * 6/1982 Hentzschel ..... D8/380
4,455,805 A * 6/1984 Rionda ..... E04B 1/2612 52/712
4,480,941 A 11/1984 Gilb
4,527,375 A * 7/1985 Braginetz ..... E04B 1/2608 52/712
4,572,695 A * 2/1986 Gilb ..... F16B 9/058 403/14
4,924,648 A 5/1990 Gilb et al.
5,109,646 A * 5/1992 Colonias ..... E04B 7/045 403/402
5,259,685 A 11/1993 Gilb
5,307,603 A * 5/1994 Chiodo ..... E04B 1/2608 52/297
5,328,287 A 7/1994 Gilb
5,372,448 A 12/1994 Gilb
5,399,044 A 3/1995 Gilb
5,448,871 A * 9/1995 Newman ..... E04B 7/04 52/712
5,457,928 A * 10/1995 Sahnazarian ..... F16B 9/058 52/696
5,467,569 A 11/1995 Chiodo
D364,794 S * 12/1995 Eberschlag ..... D8/354
5,488,810 A * 2/1996 Horton ..... F16B 9/058 52/715
5,575,130 A 11/1996 Chiodo
5,640,822 A * 6/1997 Haswell ..... E04B 7/045 52/712
5,653,079 A * 8/1997 Loeffler ..... E04C 3/16 52/715
5,699,639 A 12/1997 Fernandez
6,209,277 B1 * 4/2001 DiGate ..... E04G 23/0203 52/715
6,295,780 B1 * 10/2001 Thompson ..... E04D 12/00 52/715
7,047,695 B2 5/2006 Allen et al.
7,146,770 B2 12/2006 Simmons
7,398,620 B1 7/2008 Jones
7,637,076 B2 12/2009 Vaughn
7,793,476 B2 9/2010 Sanders et al.
7,987,636 B2 * 8/2011 Hunt ..... E04B 7/045 52/93.2
8,276,323 B2 10/2012 Gray
8,511,036 B2 * 8/2013 O'Donnell ..... E04G 21/3276 52/712
8,555,592 B2 10/2013 Daudet
8,656,650 B2 2/2014 Gray
8,800,239 B2 * 8/2014 Yang ..... E04B 1/2403 403/403
8,844,244 B2 9/2014 Gray
9,080,325 B1 7/2015 Hensen
9,091,056 B2 7/2015 Stauffer
9,297,174 B2 * 3/2016 Ventling ..... E04B 1/355
9,376,797 B2 * 6/2016 Yang ..... E04B 1/2403
9,938,709 B2 4/2018 Daudet
10,006,219 B1 6/2018 Mehrain
10,100,508 B1 * 10/2018 Fox ..... E04B 1/2604
10,202,766 B1 * 2/2019 Fox ..... E04B 7/063
10,273,678 B2 * 4/2019 Hensen ..... E04B 1/2608
10,273,679 B2 4/2019 Daudet
10,280,617 B2 * 5/2019 Monty ..... F16B 15/00
10,865,588 B2 12/2020 Raz
12,012,746 B2 * 6/2024 Beach ..... E04B 1/388
D1,050,873 S * 11/2024 Wiatrowski ..... D8/382
D1,055,677 S * 12/2024 Fox ..... D8/363
2005/0155315 A1 * 7/2005 Davis ..... E04B 7/045 52/712
2006/0059845 A1 * 3/2006 Visone ..... E04B 1/2612 52/702
2006/0150564 A1 * 7/2006 Dufault ..... E04B 7/045 52/702
2006/0193687 A1 * 8/2006 Ghosh ..... E04B 1/2604 403/401
2008/0282641 A1 * 11/2008 Sackett ..... E04B 7/045 52/715
2010/0162638 A1 * 7/2010 Hunt ..... E04B 7/045 52/92.2
2012/0297724 A1 * 11/2012 Pope ..... E04B 1/2612 52/702
2014/0305067 A1 * 10/2014 Ventling ..... E04G 21/14 16/382
2016/0177560 A1 * 6/2016 Hensen ..... E04B 1/2608 52/272
2017/0009444 A1 1/2017 Downs
2017/0103755 A1 4/2017 Jeon et al.
2018/0119413 A1 5/2018 Lin
2019/0271147 A1 * 9/2019 Hensen ..... E04B 1/2608

FOREIGN PATENT DOCUMENTS

CA 2593955 A1 * 1/2009 ..... E04B 7/045
CN 111677128 A * 9/2020 ..... E04B 1/10
EP 913535 A1 * 5/1999 ..... E04B 1/2608
FR 2847495 A1 * 5/2004 ..... B21D 53/40

(56) References Cited

FOREIGN PATENT DOCUMENTS

| | | | | | |
|---|---|---|---|---|---|
| GB | 2314862 | A | * | 1/1998 | ..... E04B 1/2608 |
| GB | 2376960 | A | * | 12/2002 | ..... E04B 1/2608 |
| WO | WO-2014121326 | A1 | * | 8/2014 | ..... E04B 1/26 |

OTHER PUBLICATIONS

"Superspeed Connectors Structural Wood Fasteners," Catalog, Jan. 1975, front cover and pp. 12-13, Golden Gate Equipment, San Francisco, CA.
"Versatile, Easy-to-Install Post Caps," catalog, Dec. 2014, 2 pages, Simpson Strong-Tie Company, Inc., Pleasanton, CA.
"Wood Construction Connectors," Catalog, 2006, front and back covers and pp. 52-54, vol. C-2006, Dssd Simpson Strong-Tie Company, Inc, Dublin, CA.
"Galvanized Post Cap," "Corner Post Cap," Semco Metal Connectors Catalog, 1997-1998, front and back cover and p. 28, Semco, Jacksonville, FL.
"Caps & Bases: PB/PBS Regular and Standoff Post Bases," Wood Construction Connectors Catalog, 2008, front and back cover and p. 49, C-2008, Simpson Strong-Tie Company Inc., Pleasanton, CA.
"High Wind-Resistant Construction: Corner Post/col. to Beam," High Wind-Resistant Construction Catalog, 2009, front and back cover and p. 29, C-HW09, Simpson Strong-Tie Company Inc., Pleasanton, CA.
"Caps & Bases: BC/BCS Post Caps," "LCC Lally col. Caps," Wood Construction Connectors Catalog, 2006, front and back cover and p. 51, C-2006, Simpson Strong-Tie Company Inc., Pleasanton, CA.
"RTA/RTB/RTF/RTT/RTU/FW2 Rigid Tie Connectors," Connectors for Wood Construction Product & Instruction Manual, 1995, front and back cover and p. 67, C-95H-1, Simpson Strong-Tie Company Inc., Pleasanton, CA.
"H Seismic & Hurricane Anchors," "FC Framing Clips," "HH Header Hangers," Connectors for Wood Construction Catalog, 1985, front and back cover and p. 28, 85H-1, Simpson Strong-Tie Company Inc., Pleasanton, CA.

* cited by examiner

COLUMN CAP

BACKGROUND OF THE INVENTION

This invention provides an improved steel connector for joining a post to a beam, typically known as a column cap or a post cap. Typically, the joist and beam lie in a common plane with the end of the post abutting the bottom face of the beam or being in close proximity thereto. The use of the connector helps the connection to resist gravity, lateral and uplift loads.

Column caps and post caps are well known in the art. U.S. Pat. No. 963,585, granted to J. A. Kimball in 1910 teaches a sheet-metal, channel-shaped connector where legs for connecting to the post are bent down from the seat and then bent back on themselves 180 degrees to reach up and grab the sides of the beam. U.S. Pat. No. 1,848,085, granted to L. A. Eisenschmidt in 1932, also teaches a channel-shaped connector made from sheet-metal. In this patent the legs that grab the post are bent from the seat at its sides and the walls of the channel are bent up from the front and back edges of the seat. U.S. Pat. No. 2,084,758, granted to A. R. Anderson in 1937, also teaches a channel-shaped connector. In this case the legs for attaching the connector to the post are formed from portions that would otherwise be the walls of the channel and are bent down from the seat of the channel to grasp the post. This patent also teaches an extension on one of the sides of the channel that further strengthens the connection between the post and the beam. U.S. Design Pat. D256,663, granted to Tyrell T. Gilb in 1980, also teaches a channel-shaped connector where legs for attaching to the post are formed from the walls of the channel and are bent down from the seat of the channel to grasp the post. U.S. Pat. No. 5,488,810, granted to Jim W. Horton in 1996, teaches a sheet-metal, channel-shaped connector where the legs for attaching the connector to the post are cut from the seat and extend downwardly from the walls of the channel.

The present invention improves upon the prior art devices by maximizing the material used to make the connection to the post through the legs while not comprising the integrity of the seat or web of the connector, and being easy to install.

SUMMARY OF THE INVENTION

The present invention provides a connection between angularly joined supported and supporting members by means of a connector. Selected embodiment of the present invention improve on the prior art column caps by providing one or more projecting tabs to hold the column cap connector on the top of the post or supporting member, at least during installation, while still creating sufficient material for the legs to attach the column cap to the post or supporting member.

The connector of the present invention has a channel length with a central web portion and upstanding spaced and substantially parallel side walls to cradle a supported member such as truss or beam and depending legs to attach the connector to the supporting member, such as a post. The attachment legs are formed from the material of the web. The projecting tabs that support the connector on the top of the post can be formed from the web or seat of the connector or they can project from the side walls of the connector. The projecting tabs can remain in place interfacing with both the end face of the supporting post and the bottom surface of the supported member, or they can be designed to bend, such that during installation, when the connector is placed on the post and before it is connected to the post with fasteners the projecting tabs interface with the end face of the supporting member and hold the connector at the proper level, but when the supported member is received by the connector, the projecting tabs are bent out of the way, such that the supported member sits directly on the supporting member.

In one preferred embodiment attachment legs are provided that are formed from both the seat or web of the channel and the opposed side wall thus increasing the attachment length of the lengths. The legs extend farther down from the top of the post, distributing the fasteners entering along the length of the post and away from the end of the post which helps to prevent splitting of the post.

In one preferred embodiment, the attachment legs are wider where they attach to the side walls of the connector so as to increase the strength of the connector at this junction. In another preferred embodiment, the attachment legs are twisted so that two distinct surfaces of each attachment leg interface with two surfaces of the post, and fasteners are driven in the sides of the post beneath the extending portions of the beam.

Preferably, the connector of the present invention is formed from a flat blank of sheet steel which is cut, punched, and folded to form the final shape of the connector without welding or connecting additional pieces to the connector. In one preferred embodiment, the attachment legs are formed with alternating widening and narrowing portions so as to provide for the spacing of the fasteners that connect the attachment legs to the supporting member.

DETAILED DESCRIPTION OF THE INVENTION

Figure 1:
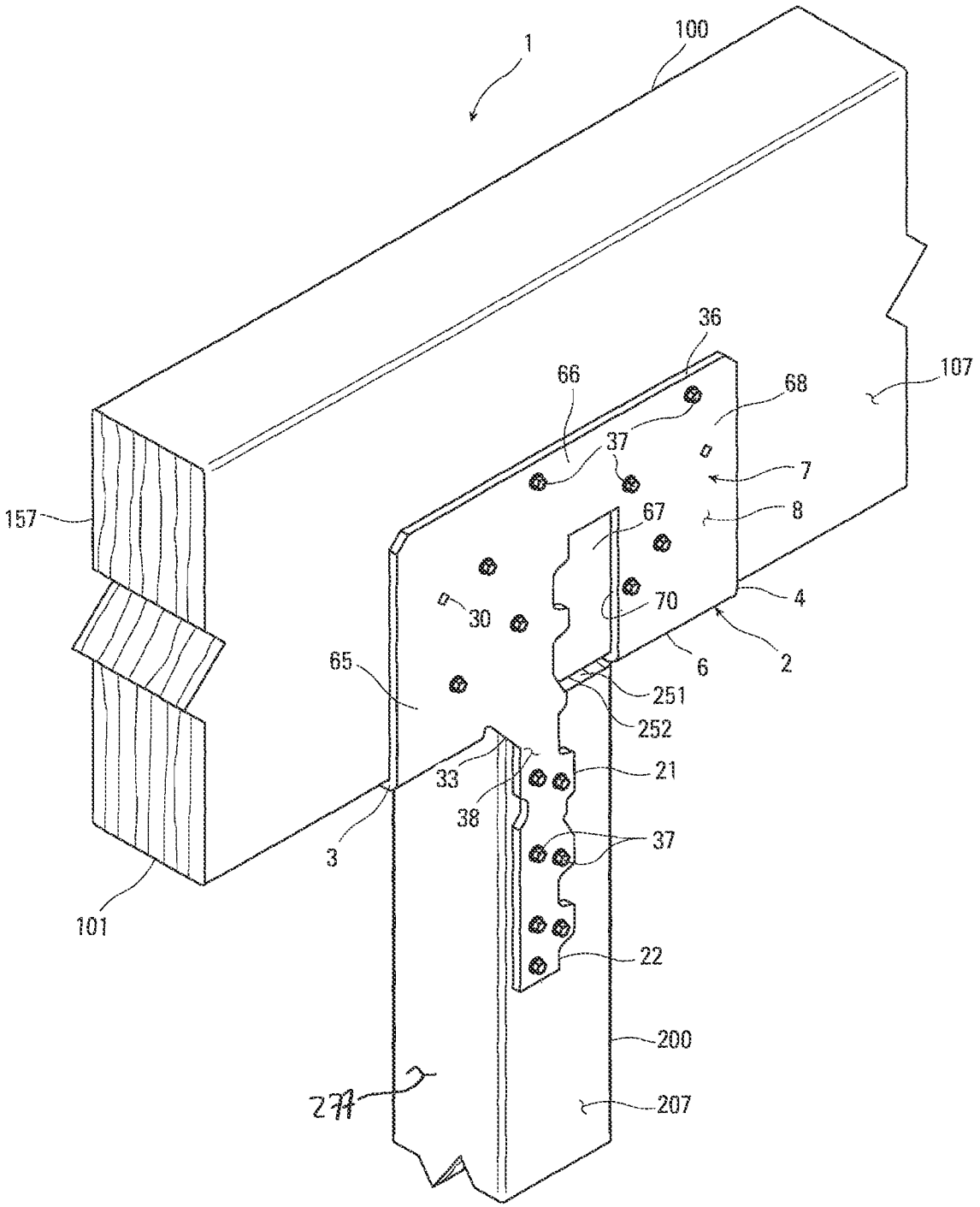
FIG. 1 is a perspective view of the connection of the present invention using one form of the connector.

As shown in FIGS. 1, 2, 17, 30 and 37, the present invention is an improved connection 1 between a supported member 100, preferably a beam, and a supporting member 200, preferably a post, made with a connector 2, with the supporting member 200 in abutting relation or near abutting relation to the supported member 100, and preferably, in some embodiments, with portions of the connector 2 disposed between the supported member 100 and the supporting member 200.

As shown in FIGS. 2, 4, 5 and 6, the connector 2 has a first end 3 and a second end 4, and a web or seat 5. In the preferred embodiments, the web 5 is interrupted. The web 5 has first and second longitudinally extending edges 6 and 56 with first and second walls 7 and 57 secured to the respective edges 6 and 56. The first and second walls 7 and 57 have outer surfaces 8 and 58 facing away from the web 5, and inner surfaces 9 and 59 facing toward each other and inwardly toward the web 5. The walls 7 and 57 extend longitudinally along the first and second edges 6 and 56 and extend upwardly from the web 5 to support and stabilize the beam 100. The first wall has a top edge 36, and the second wall has a top edge 86.

As shown in FIG. 1, the connector 2 is adapted to receive a beam 100 on or above the web 5 and between the walls 7 and 57. As shown in FIGS. 8, 9, 15, 28 and 28, in selected embodiments, preferably portions of the web or seat 5 are designed to rest on the substantially planar end face 251 of the post 200. End face 251 of post 200 is defined by edges 252. The central web 5 is preferably disposed beneath and in supporting relation to the beam 100.

As shown in FIG. 1, the beam 100 preferably has a substantially planar bottom surface 101 that interfaces with portions of the web 5 of the connector 2 and the beam has first and second side surfaces 107 and 157 that are substantially planar and preferably interface with the inner surfaces 9 and 59 of the walls 7 and 57.

In all of the embodiments of the invention, the connector 2 has one or more central apertures 18 in the web 5. As shown in FIGS. 6, 8, 15, 20, 22, 26, 28, 33, 35, 40 and 42, web 5 has a first central edge 23 that borders a central aperture 18 and lies nearer to the first end 3 of the connector 2 than the second end 4 of the connector 2. The web 5 also has a second central edge 24 that borders a central aperture 18 and lies nearer to the second end 4 of the connector 2 than the first end 3 of the connector 2.

As shown in FIGS. 3, 4, 5 and 6, in all of the embodiments, the connector 2 also has first and second attachment legs 21 and 71. The first and second attachment legs 21 and 71 are formed from material removed from the web 5 to create the one or more central apertures 18. The leg 21 has an outer face 38 that preferably extends from the outer surface 8 of the first wall 7. The leg 21 projects from, is integrally joined to, and is preferably at least partially co-planar with the first wall 7. The second attachment leg 71 is also formed from material removed from the web 5 to create the central aperture 18. The attachment leg 71 has an outer face 88 that preferably extends from the outer surface 58 of the second wall 57. The second leg 71 projects from, is integrally joined to, and is, preferably, at least partially co-planar with the second wall 57.

Figure 5:
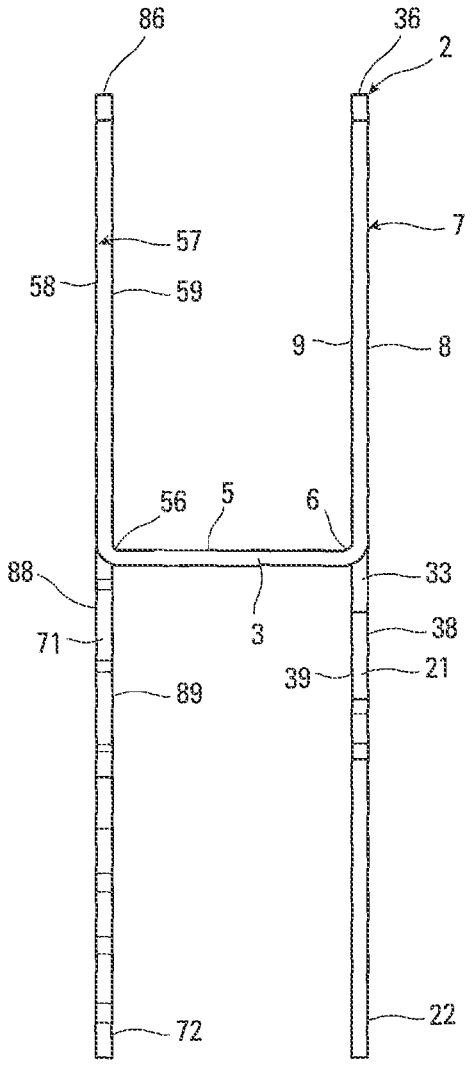
FIG. 5 is a side elevation view of the connector of FIG. 1.
Figure 6:
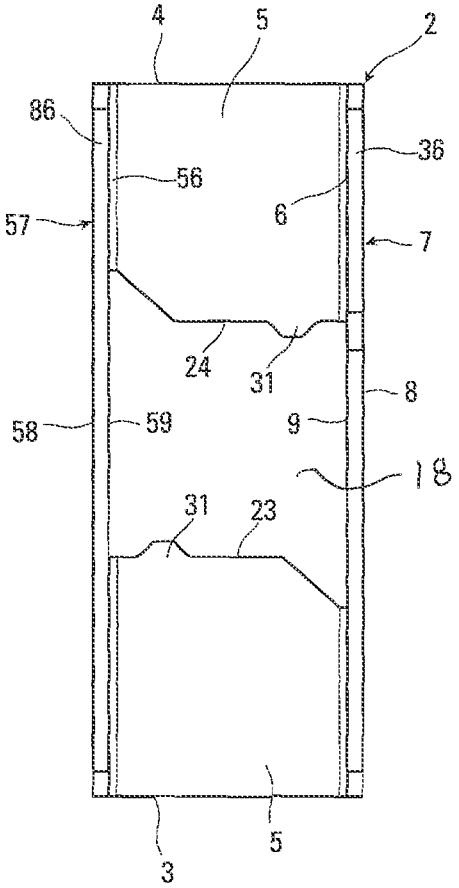
FIG. 6 is a top plan view of the connector of FIG. 1.
Figure 9:
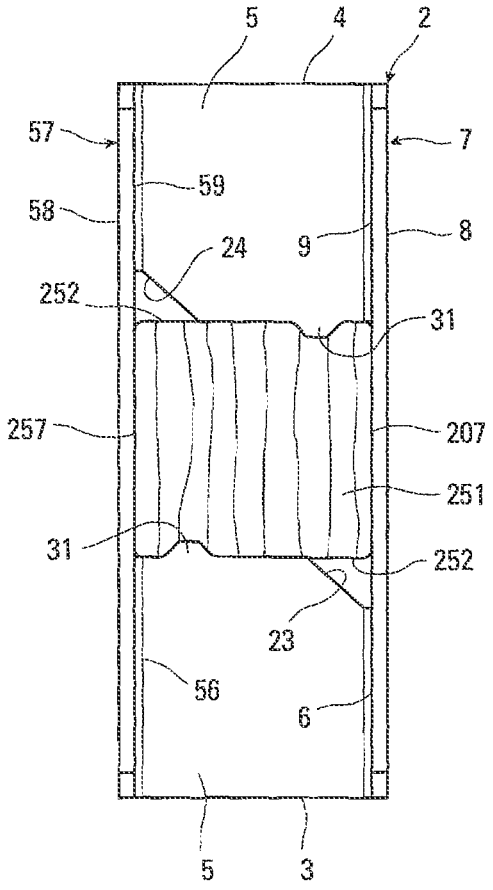
FIG. 9 is a top plan view of the connector and post of FIG. 1.

As shown in FIGS. 1, 5 and 9, the attachment leg 21 also has inner face 39 that preferably extends from the inner surface 9 of the first wall 7, and the attachment leg 71 also has an inner face 89 that preferably extends from the inner surface 59 of the second wall 57. The post 200 is preferably formed with opposed planar side surfaces 207 and 257, portions of which are in registration with the inner faces 39 and 89 of the legs 21 and 71 when the connection 1 is made.

As shown in FIGS. 6, 8, 9, 13, 15, 20, 22, 26 and 28, and in select embodiments of the invention, along the first edge 23 of the web 5 that borders central aperture 18 and between the longitudinally extending edges 6 and 56 of the web 5 the first central edge 23 is provided with one or more projecting tabs 31 that overlie the end 251 of the post 200 when the connector 2 is attached to the post 200. Projecting tabs 31 along first central edge 23 extend toward second end 4 of the connector 2. Similarly, along the second central edge 24 of the web 5 that borders the central aperture 18 and between the longitudinally extending edges 6 and 56 of the web 5 the second central edge 24 is provided with one or more projecting tabs 31 that overlie the end 251 of the post 200 when the connector 2 is attached to the post 200. Projecting tabs 31 along second central edge 24 extend toward first end 3 of the connector 2. Projecting tabs 31 prevent the connector 2 from slipping down the post 200 during installation. The use of projecting tabs 31 in the web 5 also allows more material to be used to make the connection between the attachment legs 21 and 71 and the first and second walls 7 and 57.

Figure 2:
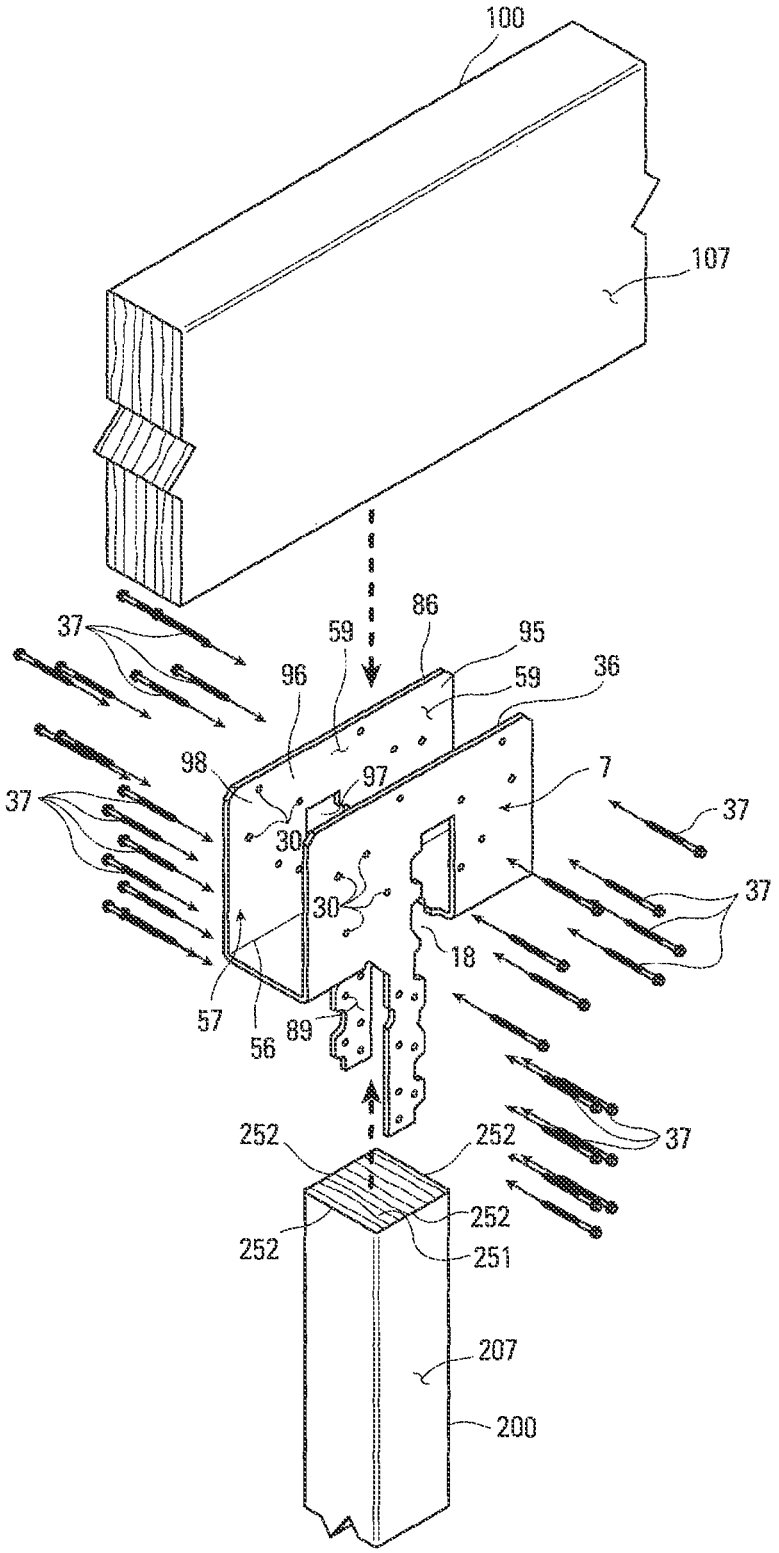
FIG. 2 is an exploded perspective view of the connection of the present invention shown in FIG. 1.
Figure 3:
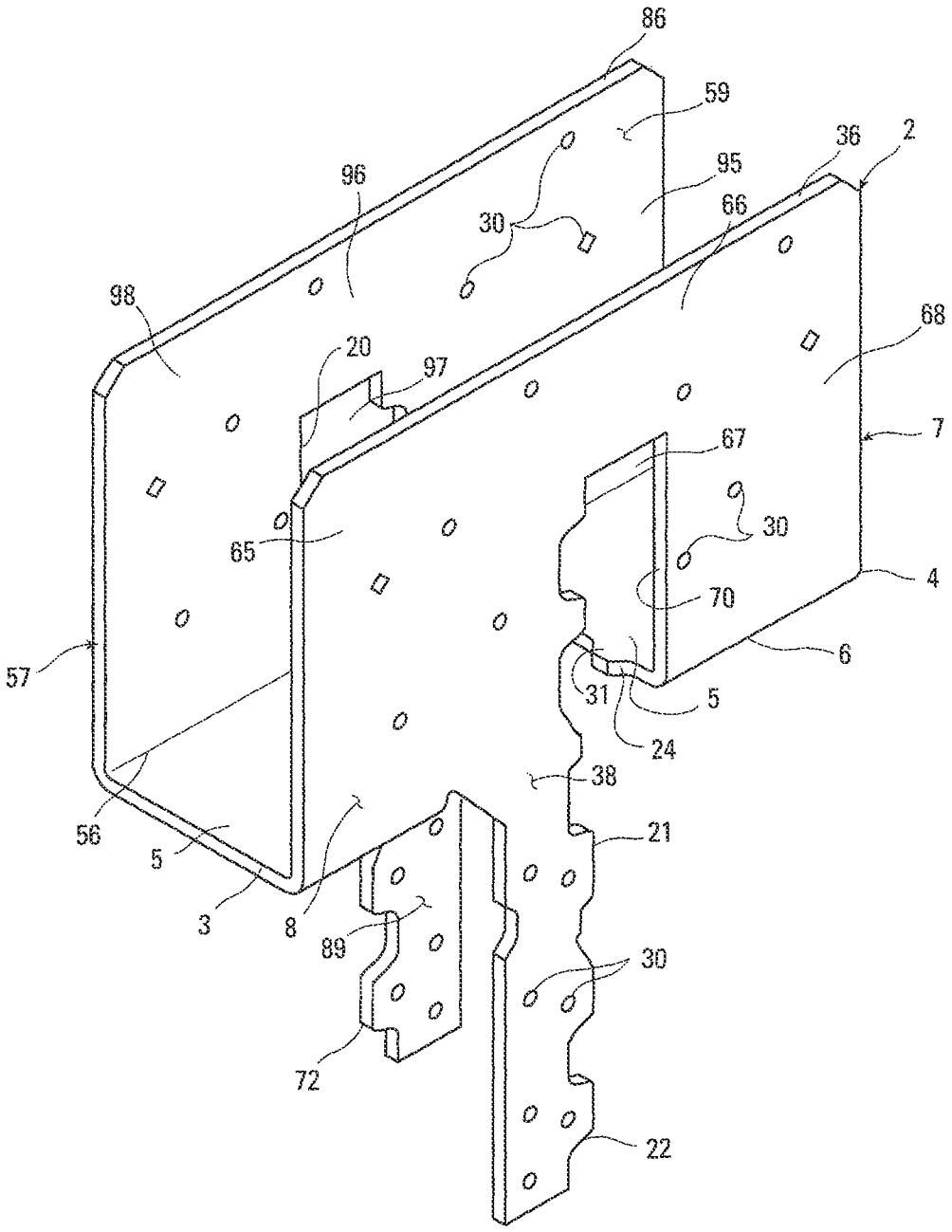
FIG. 3 is a perspective view the connector shown in FIG. 1.
Figure 4:
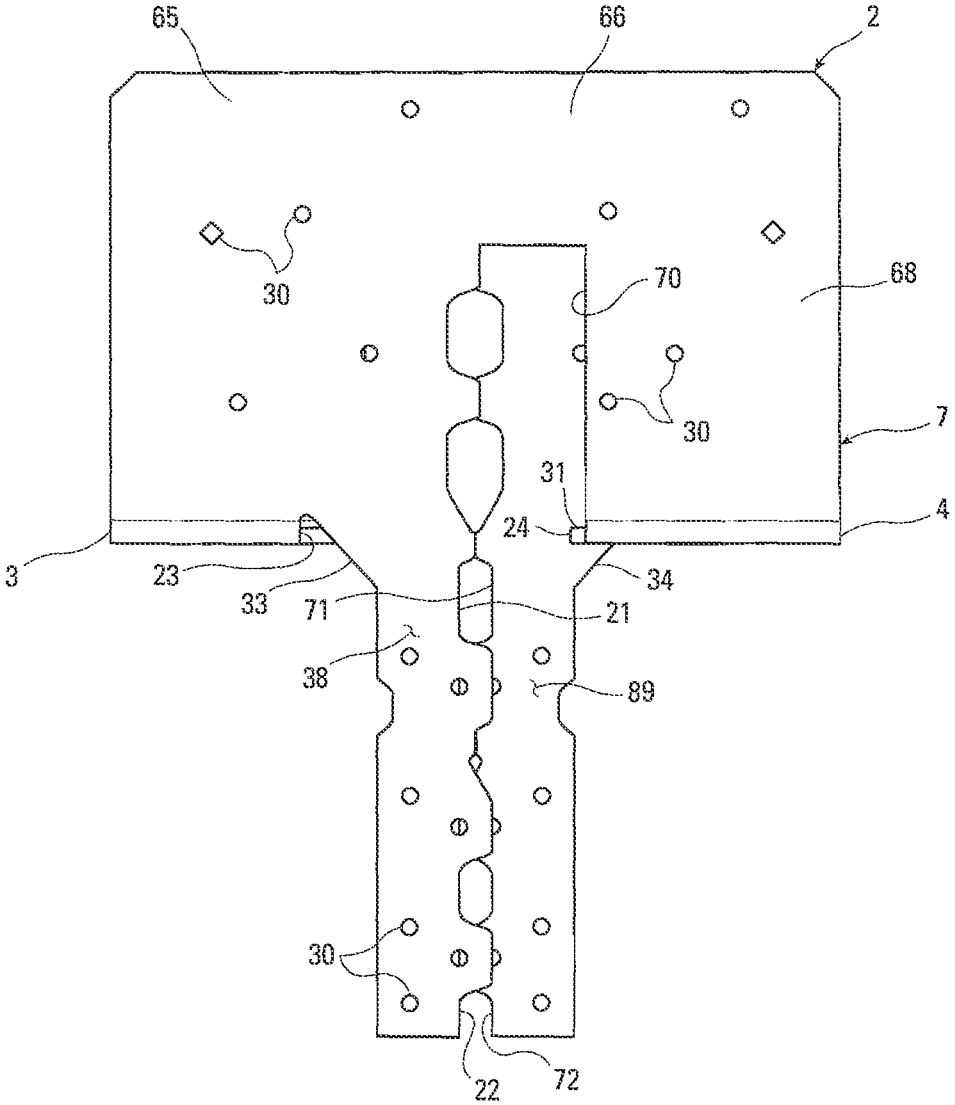
FIG. 4 is a front elevation view of the connector of FIG. 1.
Figure 10:
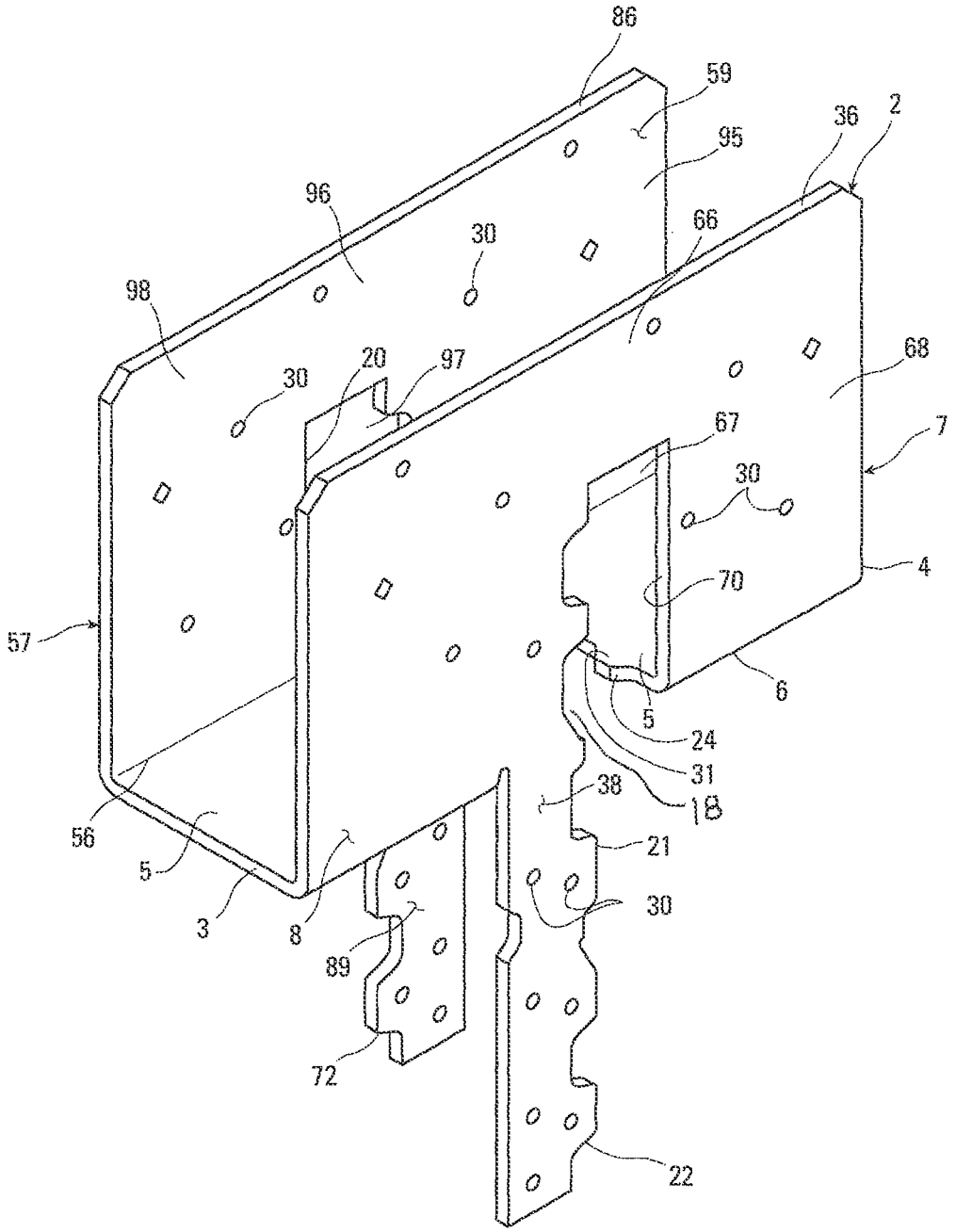
FIG. 10 is a perspective view of an alternate connector of the present invention.
Figure 11:
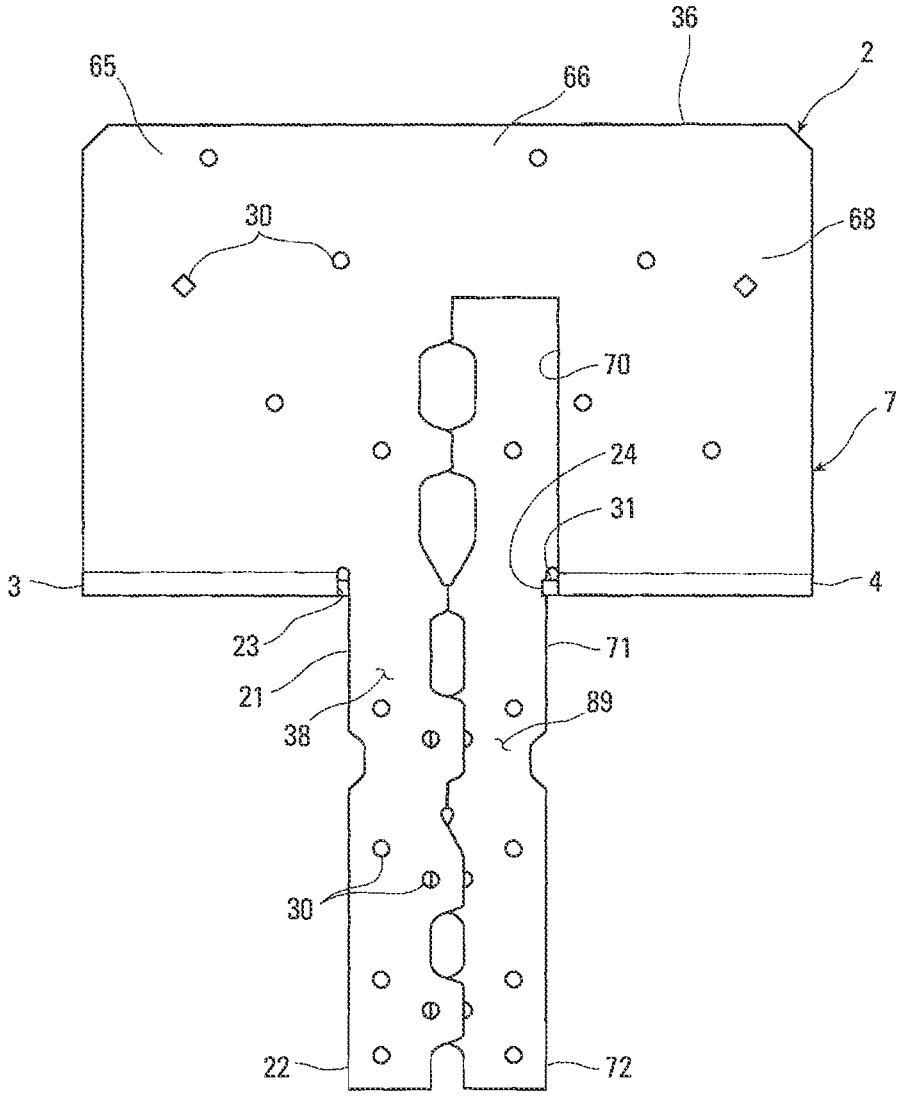
FIG. 11 is a front elevation view of the connector of FIG. 10.
Figure 12:
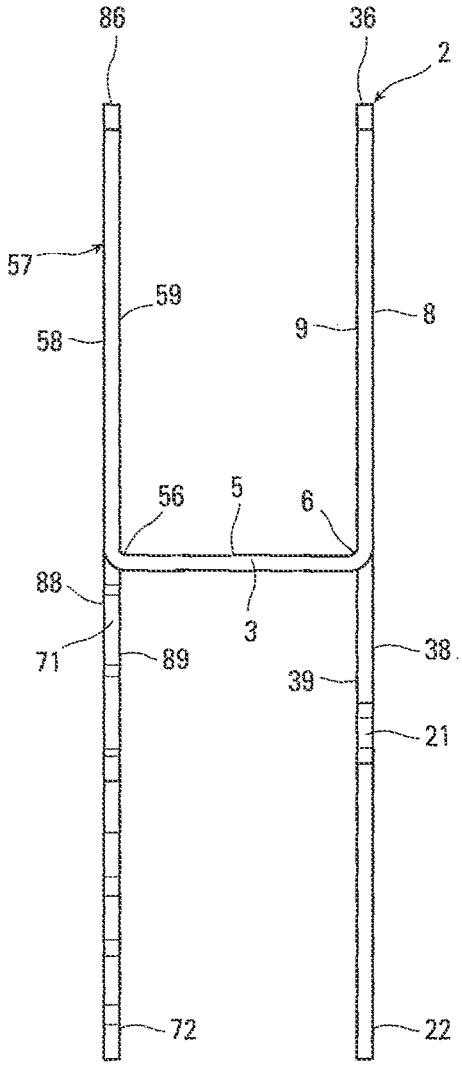
FIG. 12 is a side elevation view of the connector of FIG. 10.
Figure 13:
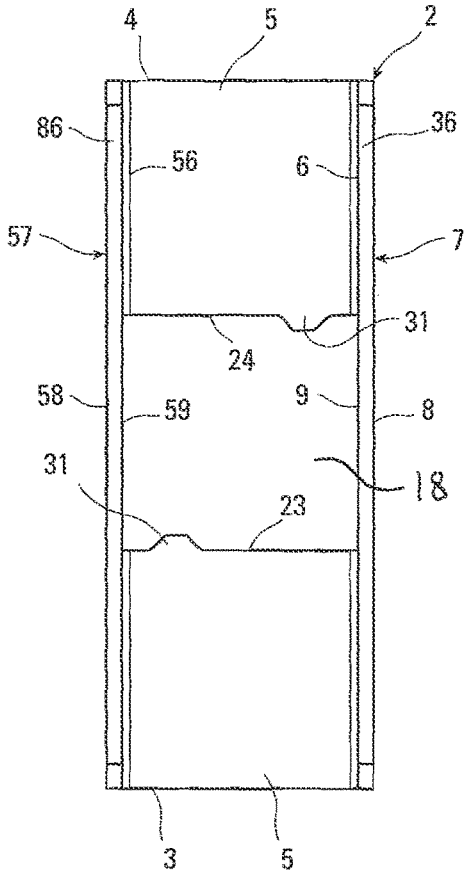
FIG. 13 is a top plan view of the connector of FIG. 10.
Figure 29:
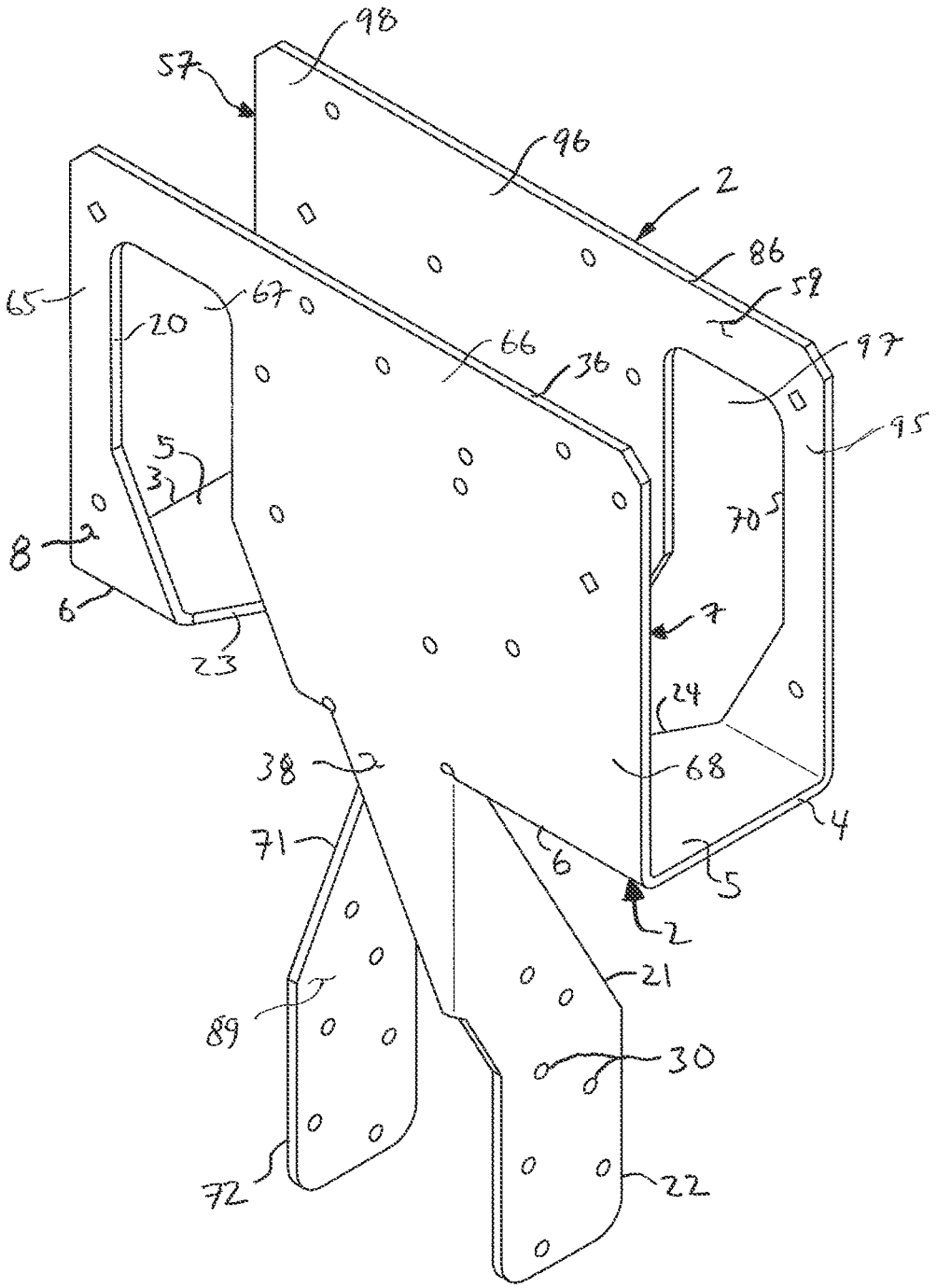
FIG. 29 is a perspective view of an alternate connector of the present invention.

As shown in FIGS. 1-15 and 29-42, in select embodiments of the invention, the central aperture or apertures 18 traverse both the first and second longitudinally extending edges 6 and 56 of the web 5, or one of the first and second longitudinally extending edges 6 and 56, to enter the first and second walls 7 and 57, forming notches 67 and 97 in the respective walls. Notch 67 in first wall 7 creates a first end portion 65 and a second end portion 68 in first wall 7 with the notch 67 between them. The first and second end portions 65 and 68 are connected by a bridge portion 66 that lies above the notch 67. Bridge portion 66 is spaced substantially away from longitudinal edge 6. Notch 97 in second wall 57 creates a first wall portion 95 and a second wall portion 98 that are separated by the notch 97 and connected by a bridge portion 96 that lies above the notch 97. Bridge portion 96 is spaced substantially away from longitudinal edge 56. As shown in FIGS. 3, 10 and 29, the central edge 23 of the web 5 continues to an upper portion 20 in the first wall 7 or second wall 57, and the central edge 24 of the web 5 continues to an upper portion 70 in the second wall 57 or the first wall 7. In these embodiments, the first and second legs 21 and 71 have extended portions or leg extensions 22 and 72 respectively made from material from the first or second walls 7 and 57 which extends the central aperture or apertures 18.

As best shown in FIGS. 4, 6, 7 and 8, in certain embodiments of the invention, along the first central edge 23 that borders the web 5 and between the longitudinally extending edges 6 and 56 of the web 5 the first central edge 23 angles away from second end 4 and toward first end 3 of the connector 2 where attachment leg 21 connects to first end portion 65 of first wall 7. Similarly, along the second central edge 24 that borders the web 5 and between the longitudinally extending edges 6 and 56 of the web 5 the second central edge 24 angles away from first end 3 and toward second end 4 of the connector 2 where attachment leg 21 connects to first end portion 95 of second wall 57. This angling of first and second central edges 23 and 24 where the attachment legs 21 and 71 join to the first and second wall 7 and 57 allows the attachment legs 21 and 71 to be wider and thus stronger. Preferably, the angling of the first and second central edges 23 and 24 is only for a portion of the first and second central edges 23 and 24 between the longitudinally extending edges 6 and 56 so as to not remove too much material from the web 5. Angling of central edges 23 and 24 creates angled sides 33 and 34 of attachment legs 21 and 71.

As shown in FIGS. 7, 14, 21, 27, 34 and 41 the connector 2 is preferably cut from a flat sheet metal blank. Fastener openings 30 are drilled or punched through the first and second wall portions 7 and 57. When the first and second wall portions 7 and 57 are bent up along the first and longitudinally extending parallel edges 6 and 56 of the channel length 2, the first and second attachment legs 21 and 71 are simultaneously bent down, enlarging the one or more central apertures 18.

Figure 7:
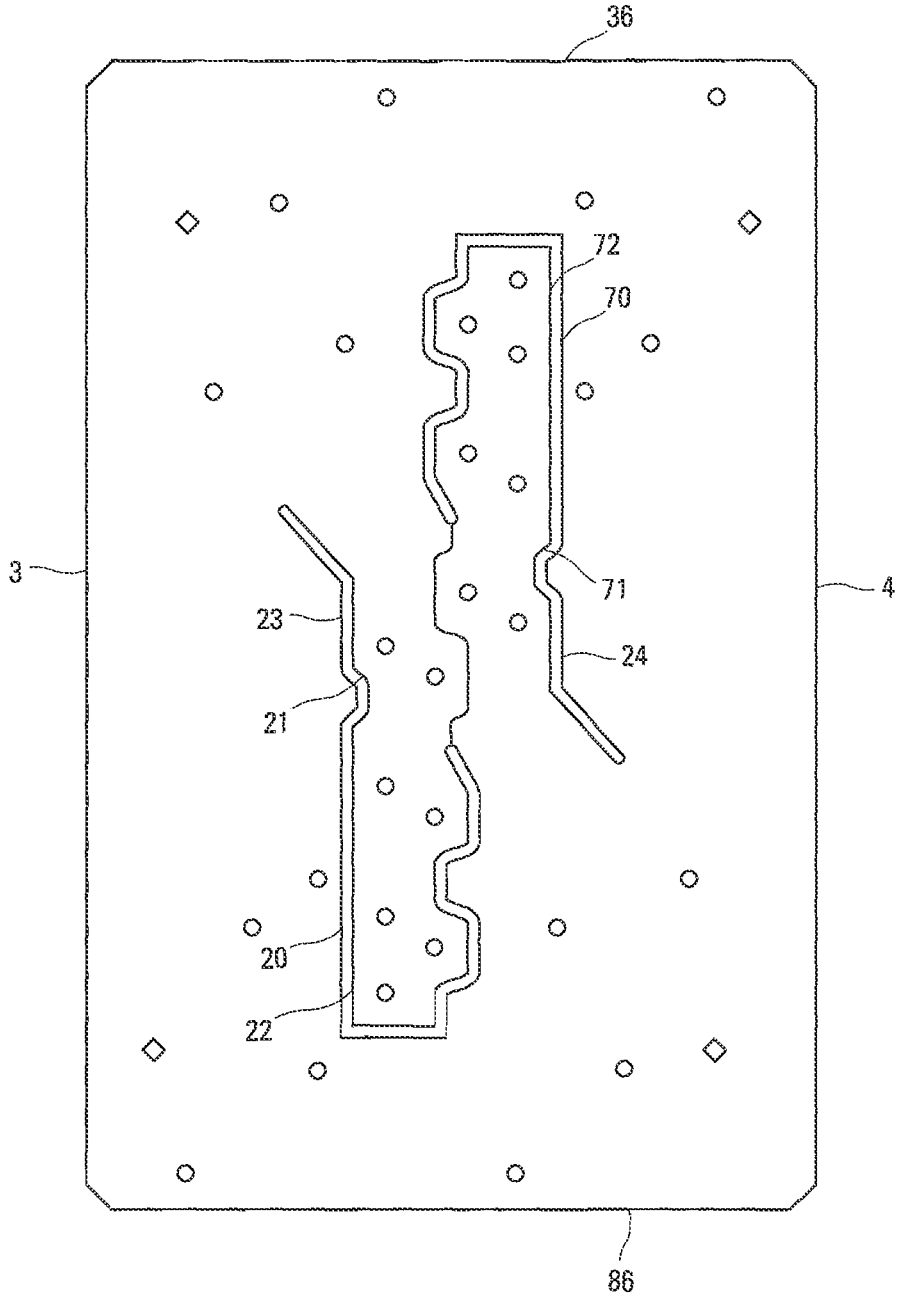
FIG. 7 is a plan view of the sheet metal blank of the connector of FIG. 1.
Figure 8:
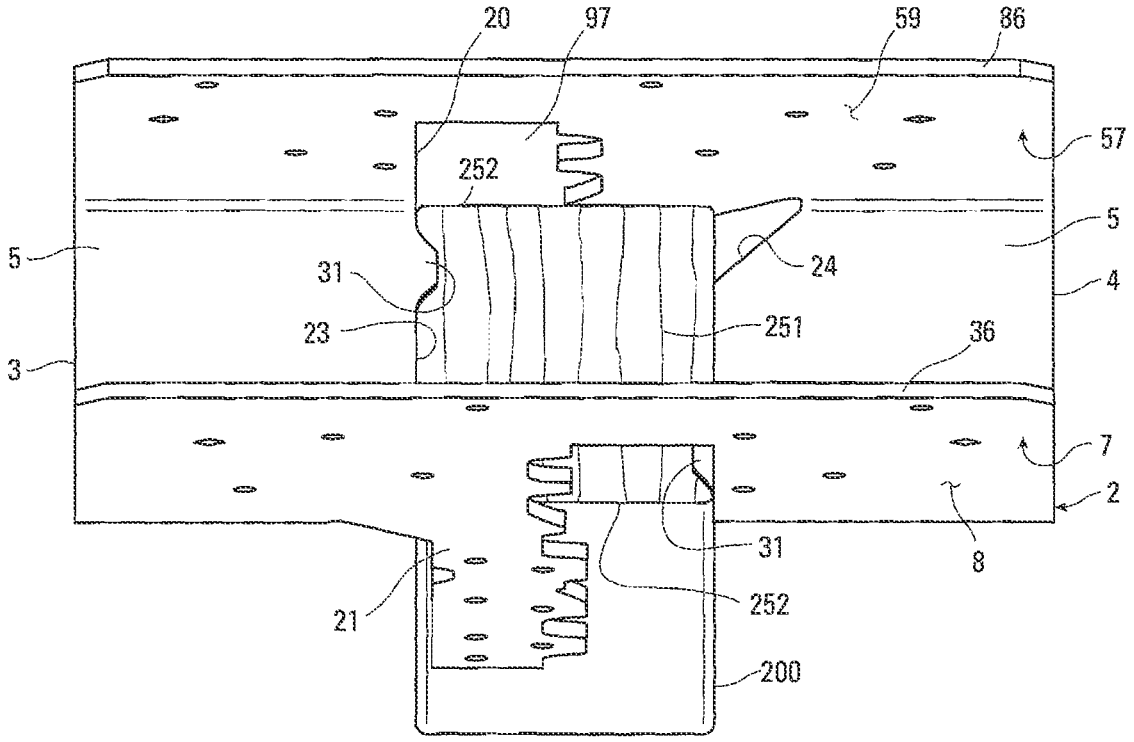
FIG. 8 is a top perspective view of the connector and post of FIG. 1.
Figure 14:
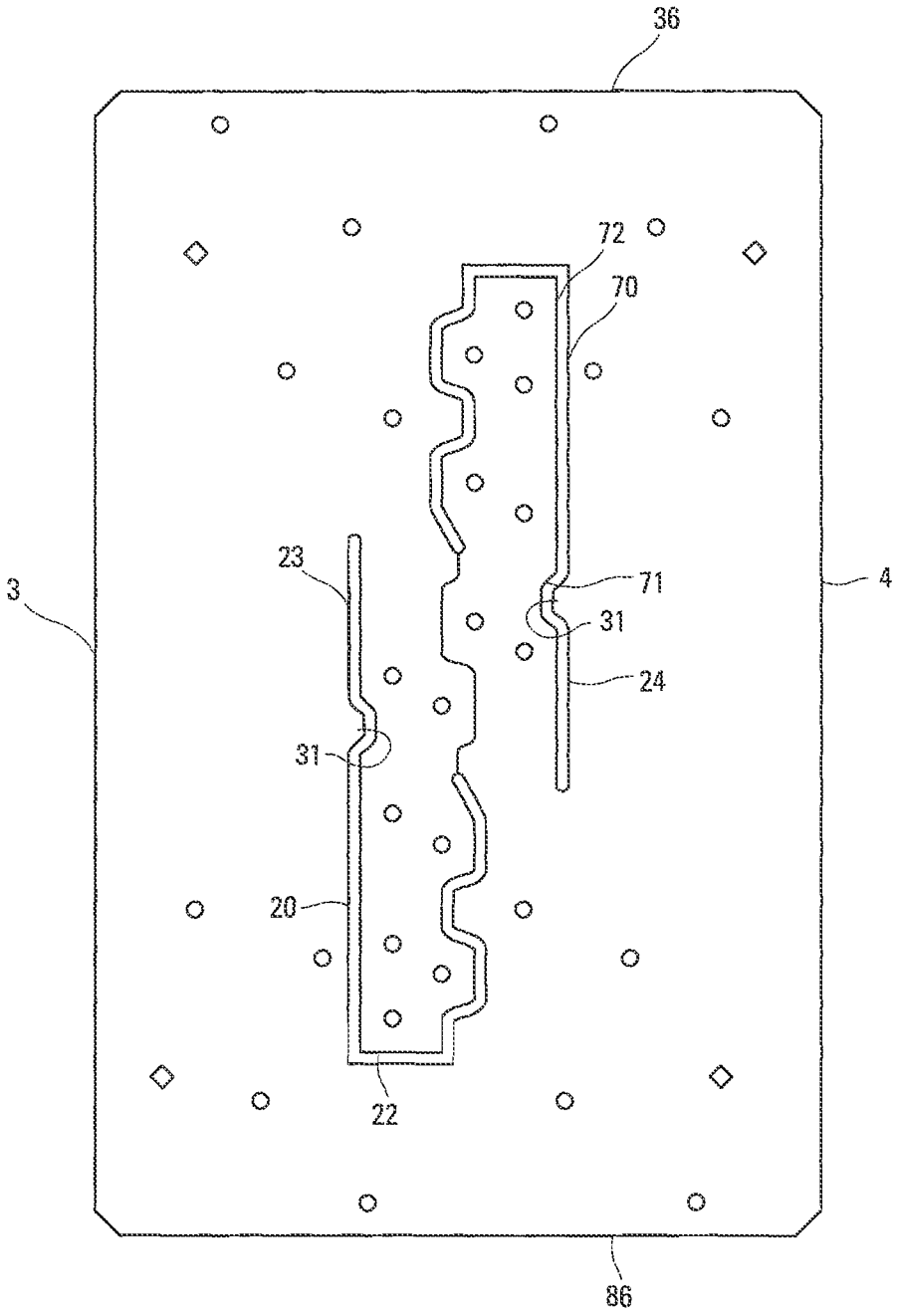
FIG. 14 is a plan view of the sheet metal blank of the connector of FIG. 10.
Figure 15:
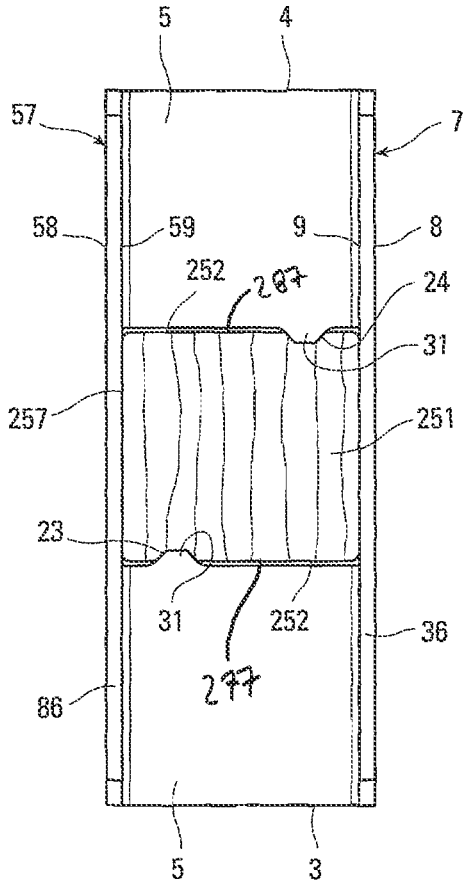
FIG. 15 is a top plan view of the connector and post of FIG. 10.
Figure 16:
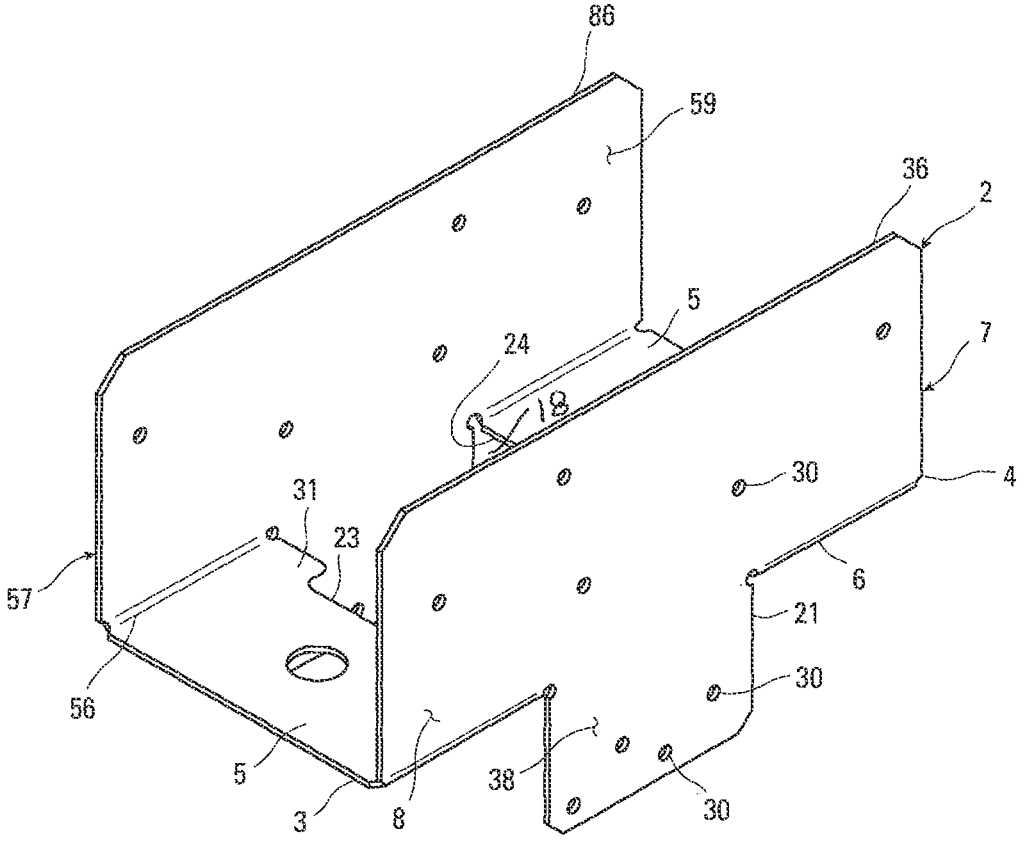
FIG. 16 is a perspective view of an alternate connector of the present invention.
Figure 17:
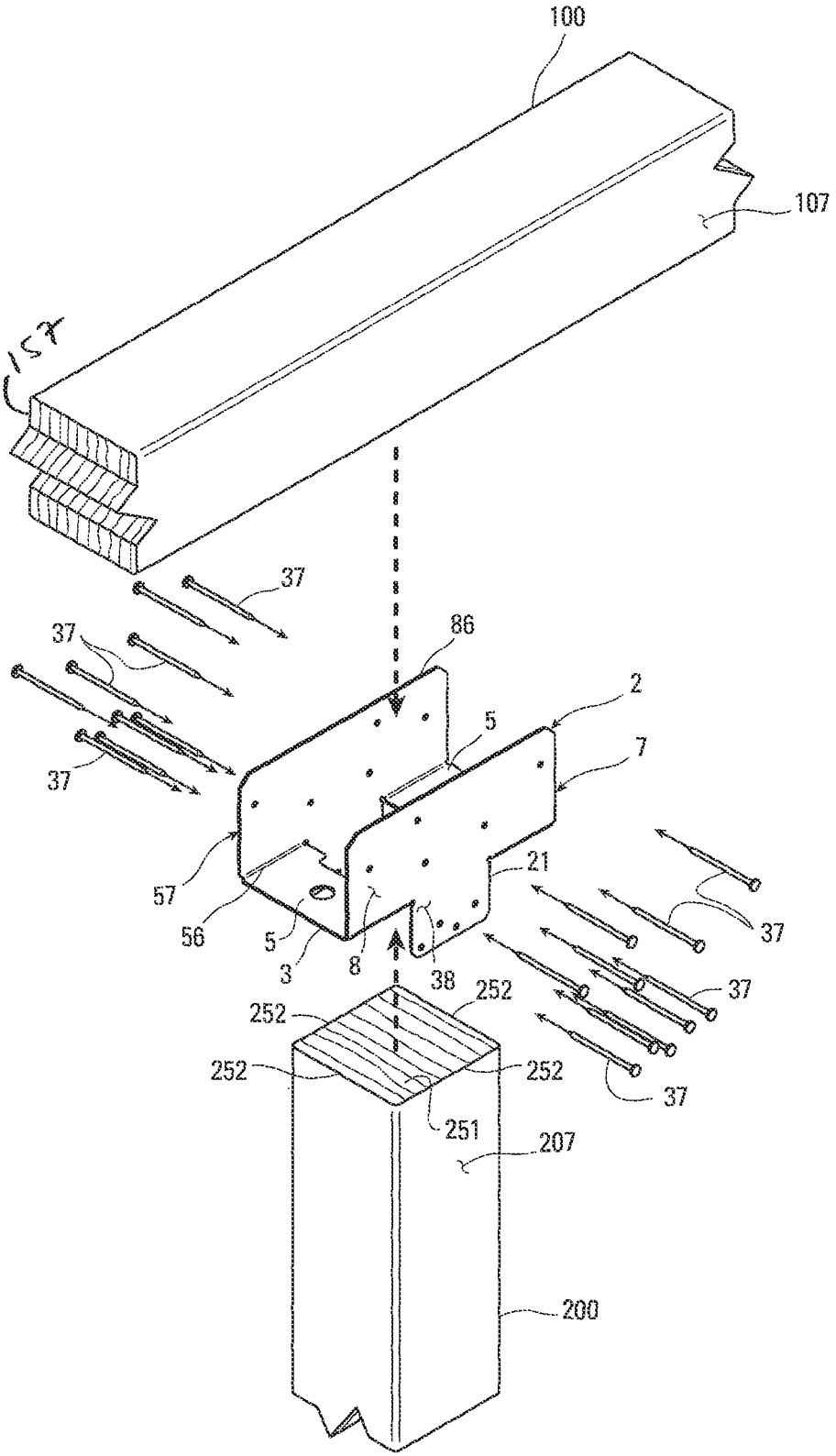
FIG. 17 is an exploded perspective view of a connection made with the connector shown in FIG. 16.
Figure 18:
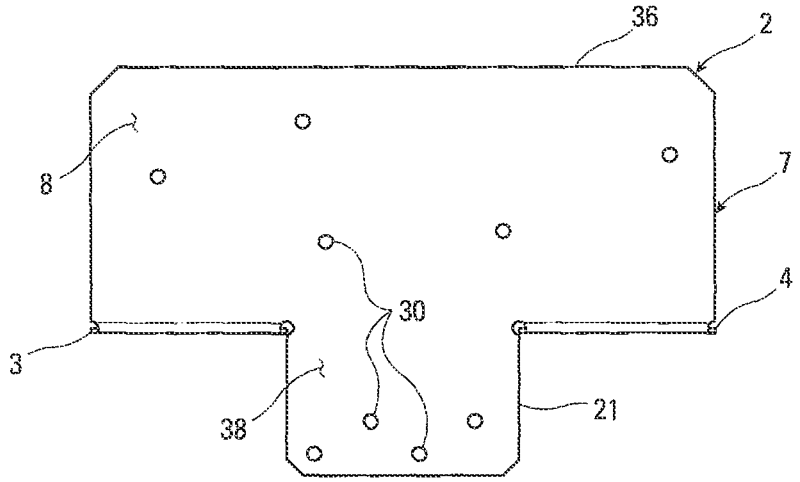
FIG. 18 is a front elevation view of the connector of FIG. 16.
Figure 19:
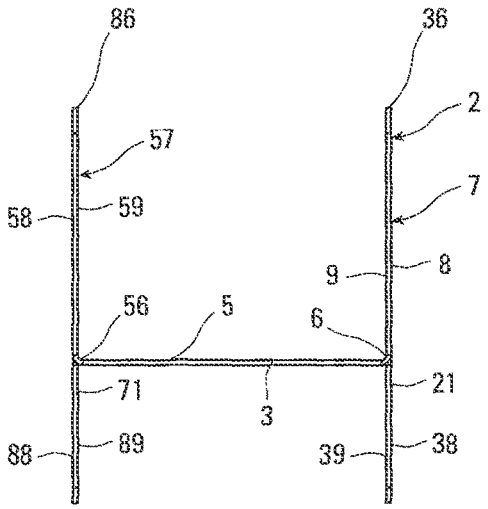
FIG. 19 is a side elevation view of the connector of FIG. 16.
Figure 20:
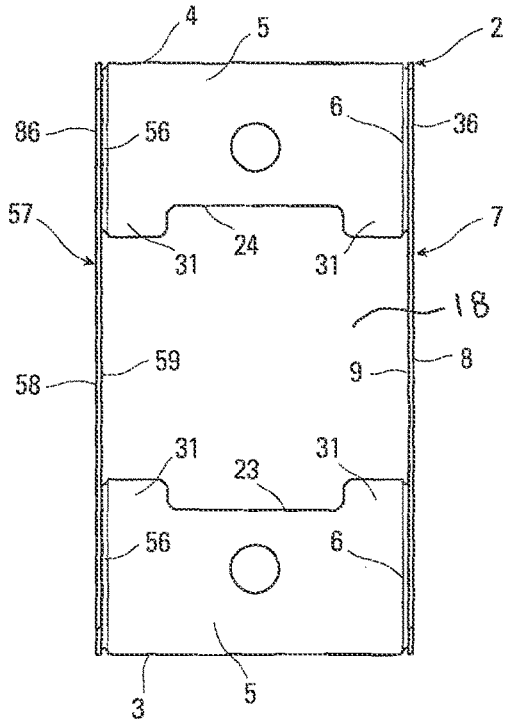
FIG. 20 is a top plan view of the connector of FIG. 16.
Figure 21:
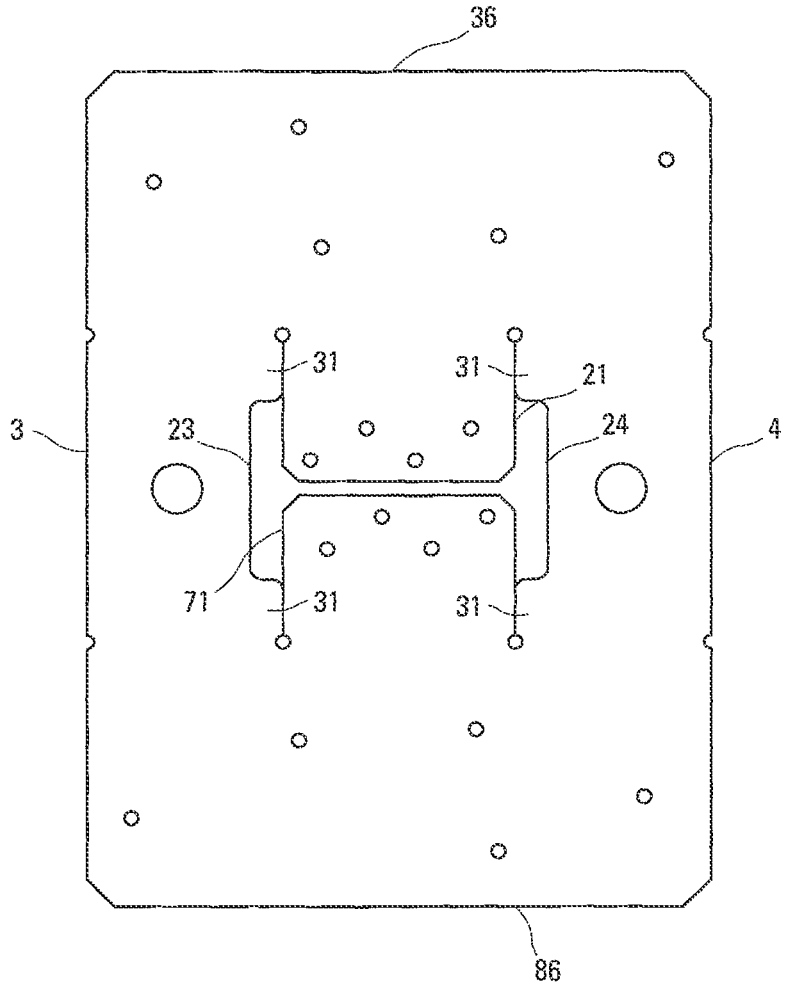
FIG. 21 is a plan view of the sheet metal blank of the connector of FIG. 16.
Figure 22:
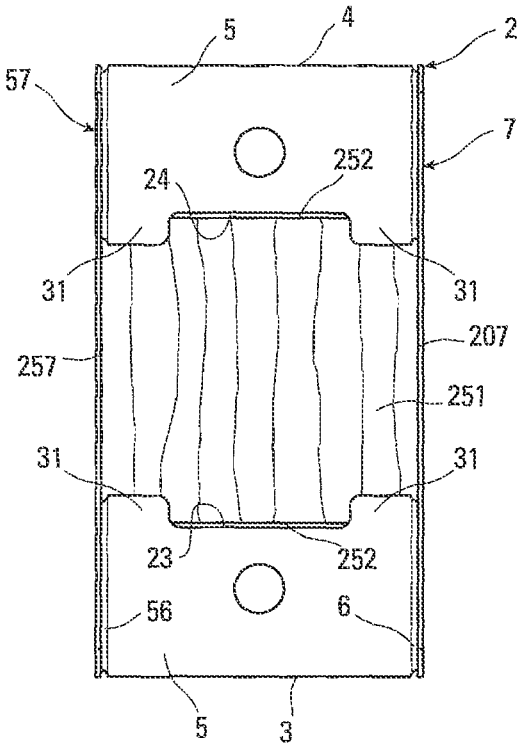
FIG. 22 is a top plan view of the connector and post of FIG. 16.
Figure 23:
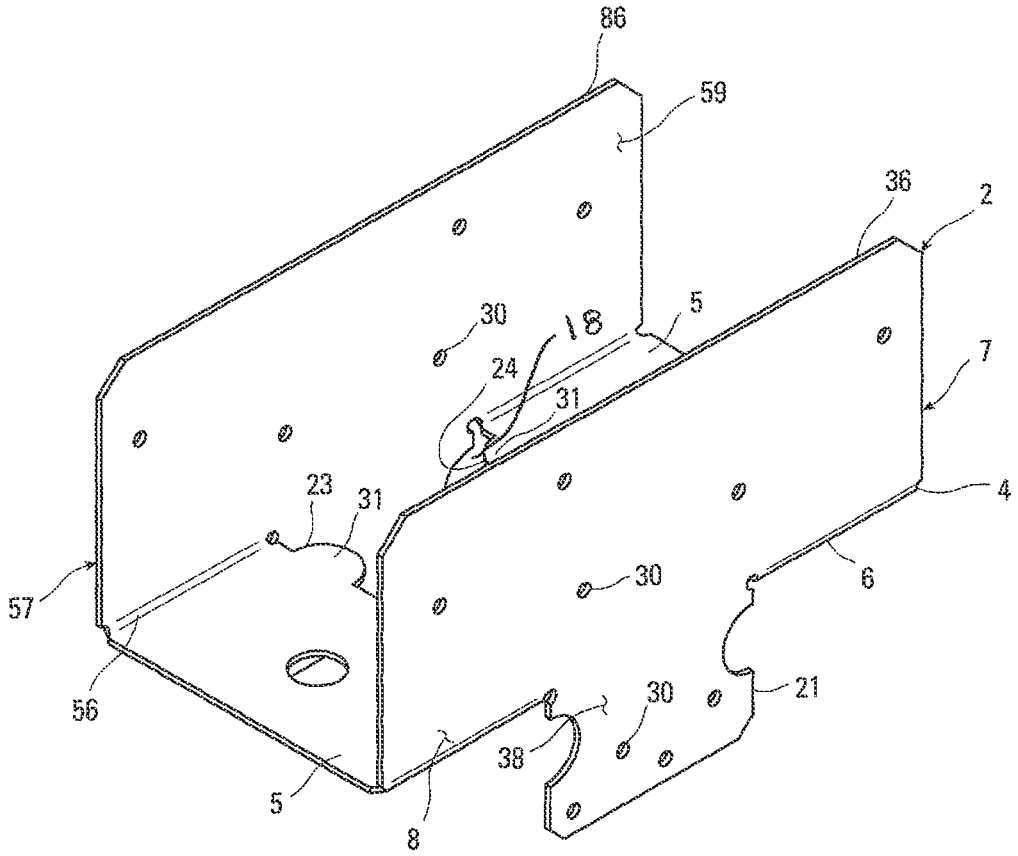
FIG. 23 is a perspective view of an alternate connector of the present invention.
Figure 24:
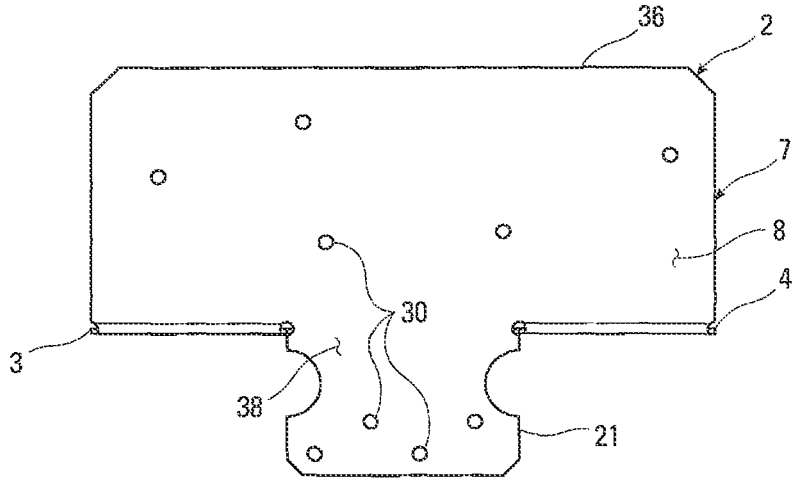
FIG. 24 is a front elevation view of the connector of FIG. 23.
Figure 25:
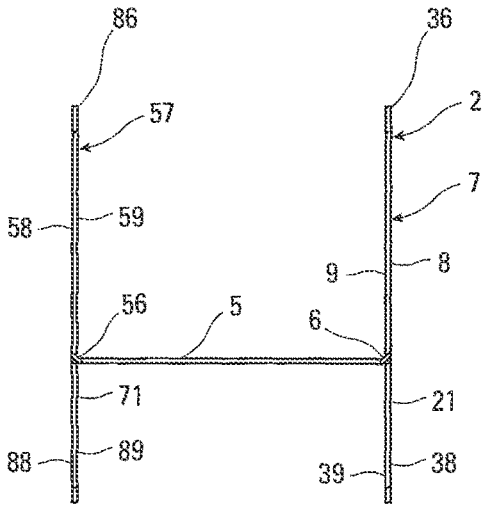
FIG. 25 is a side elevation view of the connector of FIG. 23.
Figure 26:
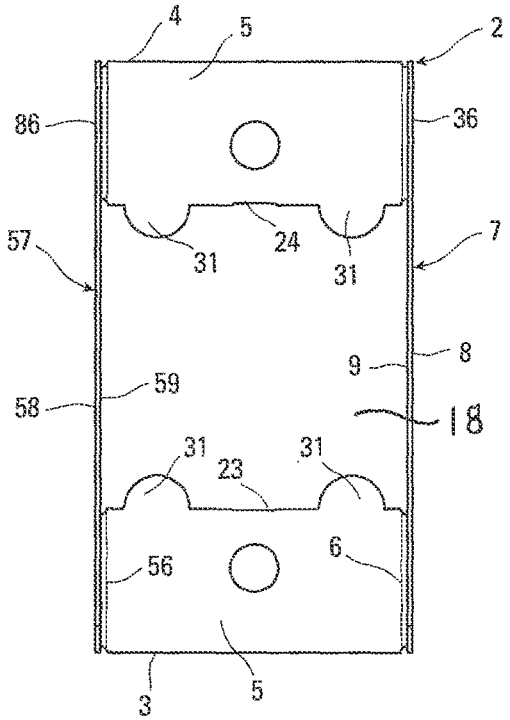
FIG. 26 is a top plan view of the connector of FIG. 23.
Figure 27:
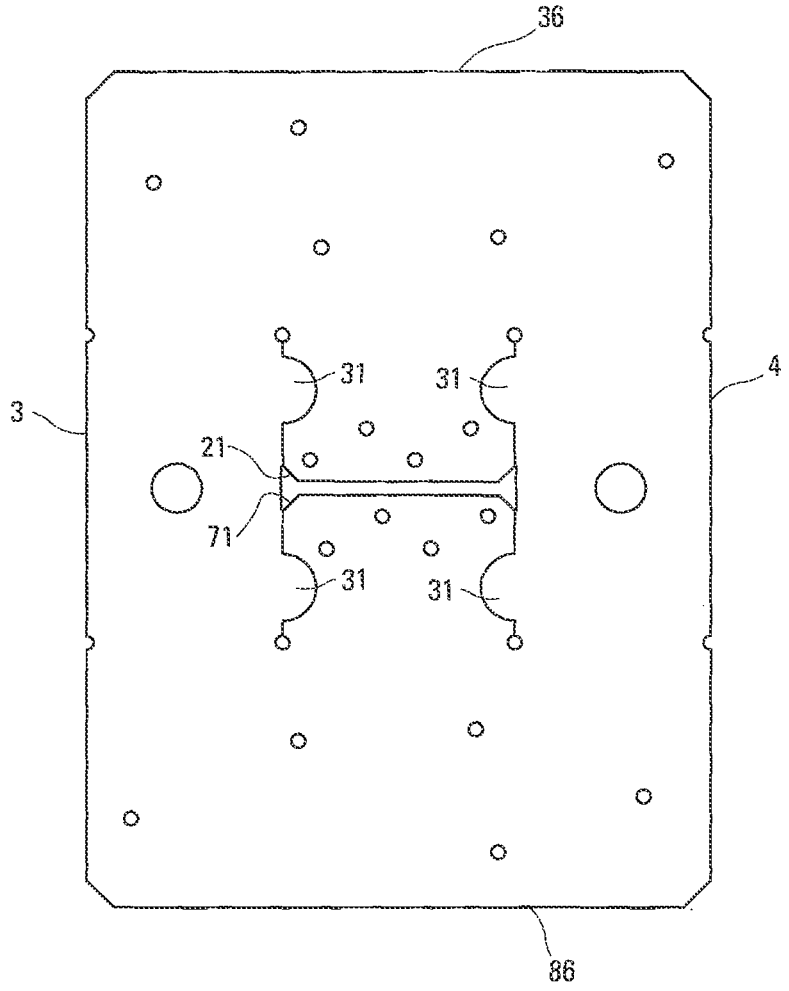
FIG. 27 is a plan view of the sheet metal blank of the connector of FIG. 23.
Figure 28:
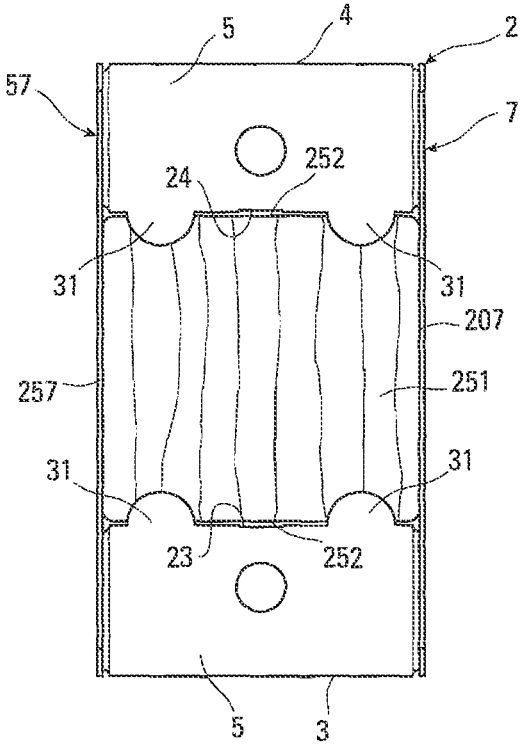
FIG. 28 is a top plan view of the connector and post of FIG. 23.

As shown in FIGS. 7 and 14, the blanks between legs 21 and 71 and between leg extensions 22 and 72 can be cut in a wavering patterns so at to make alternating and corresponding narrowing and widening portions in the attachment legs 21 and 71 and leg extension 22 and 72. This allows for the spacing of fasteners 37 so as to prevent splitting of post 200. The fasteners 37 used are preferably nails, as shown in FIG. 17, or self-drilling and self-cutting threaded fasteners 37 as shown in FIG. 2. The fasteners 37 are also driven through the side walls 7 and 57 of the connector 2 into the supported member 100.

As shown in FIG. 1, the purpose of the connector 2 is to adequately position and secure a beam 100 in an anchored relation to a post 200. The post 200 is preferably formed from wood, but another form of building material or, in fact, any other material which is strong enough and to which the legs can be connected, as by welding, fastening or adhesively bonding is possible. Preferably, the connector 2 is made from cold-formed sheet steel.

Figure 37:
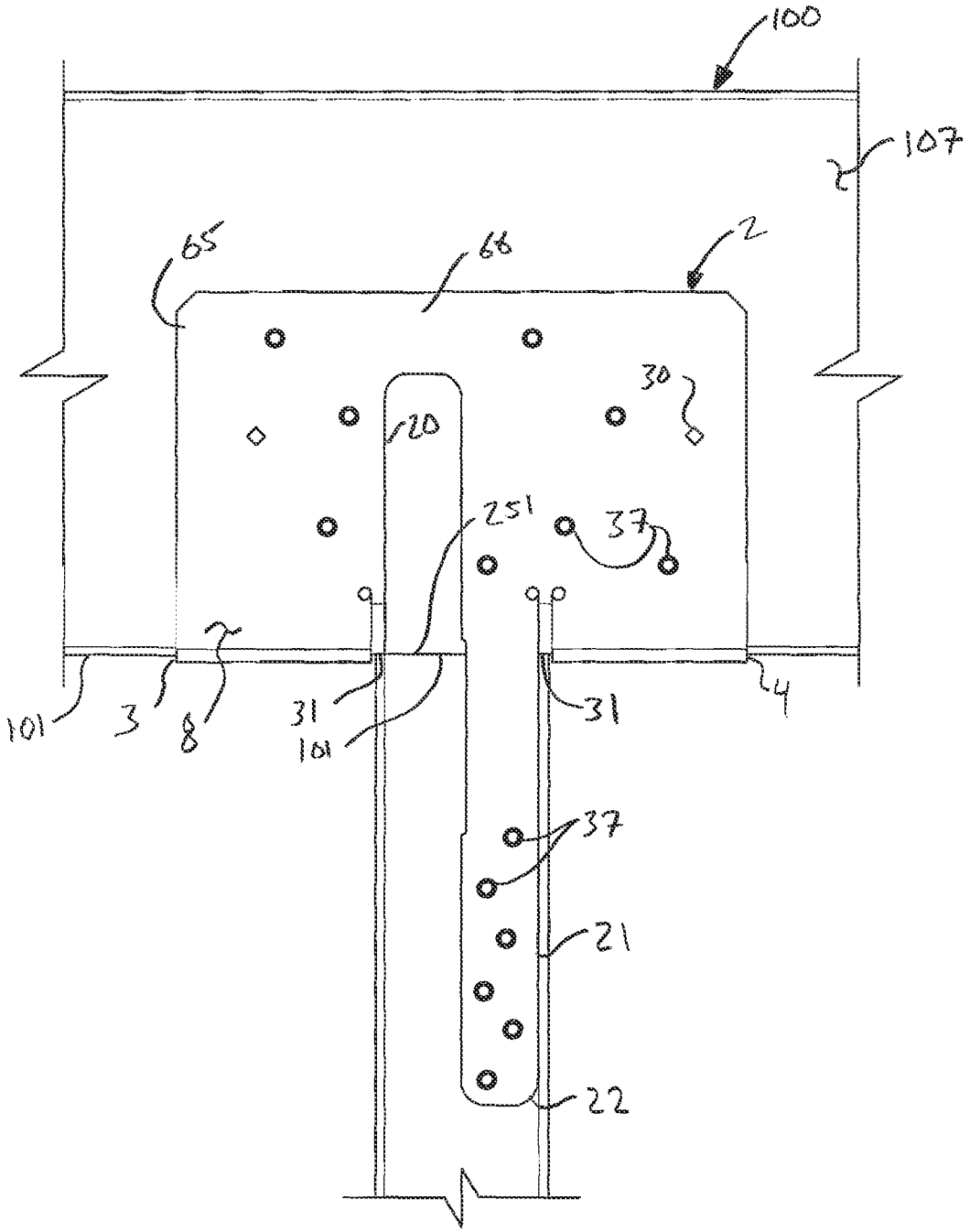
FIG. 37 is a front elevation view of the connection of the present invention made with the connector of FIG. 36.
Figure 38:
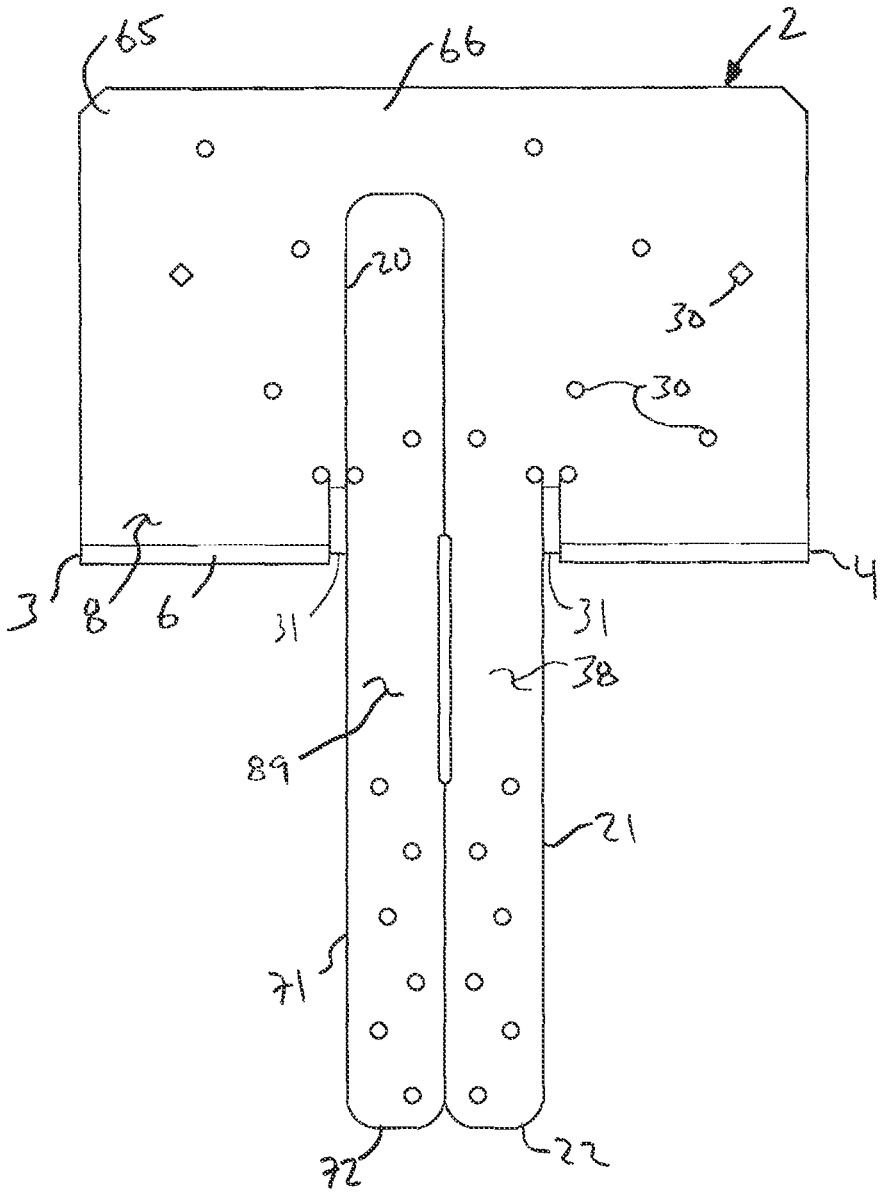
FIG. 38 is a front elevation view of the connector of FIG. 36.
Figure 39:
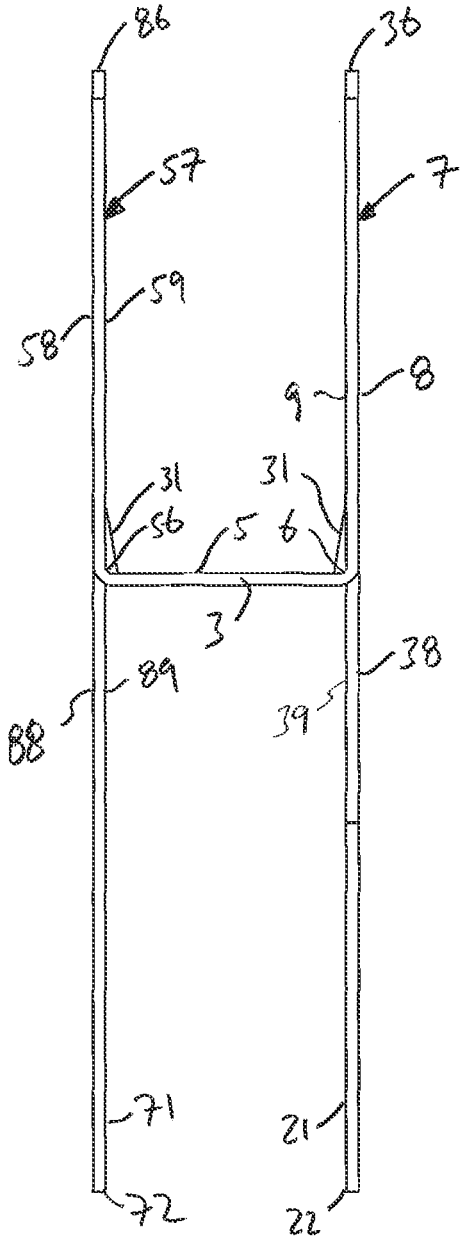
FIG. 39 is a side elevation view of the connector of FIG. 36.
Figure 40:
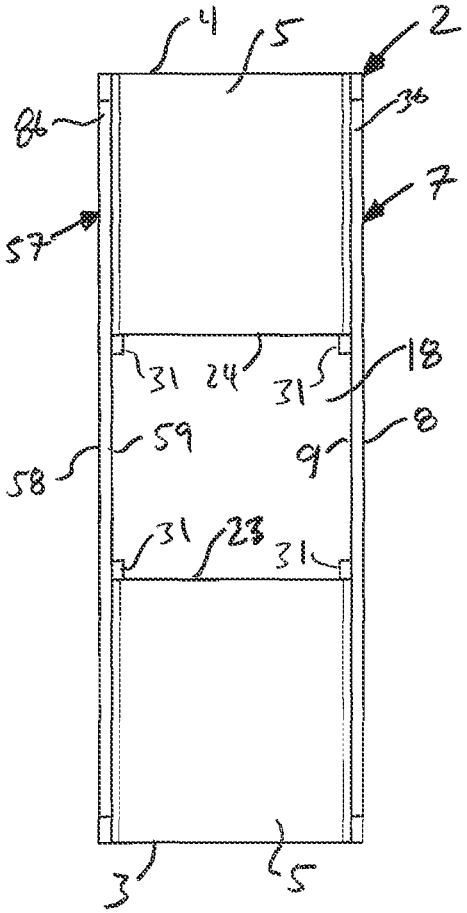
FIG. 40 is a top plan view of the connector of FIG. 36.
Figure 41:
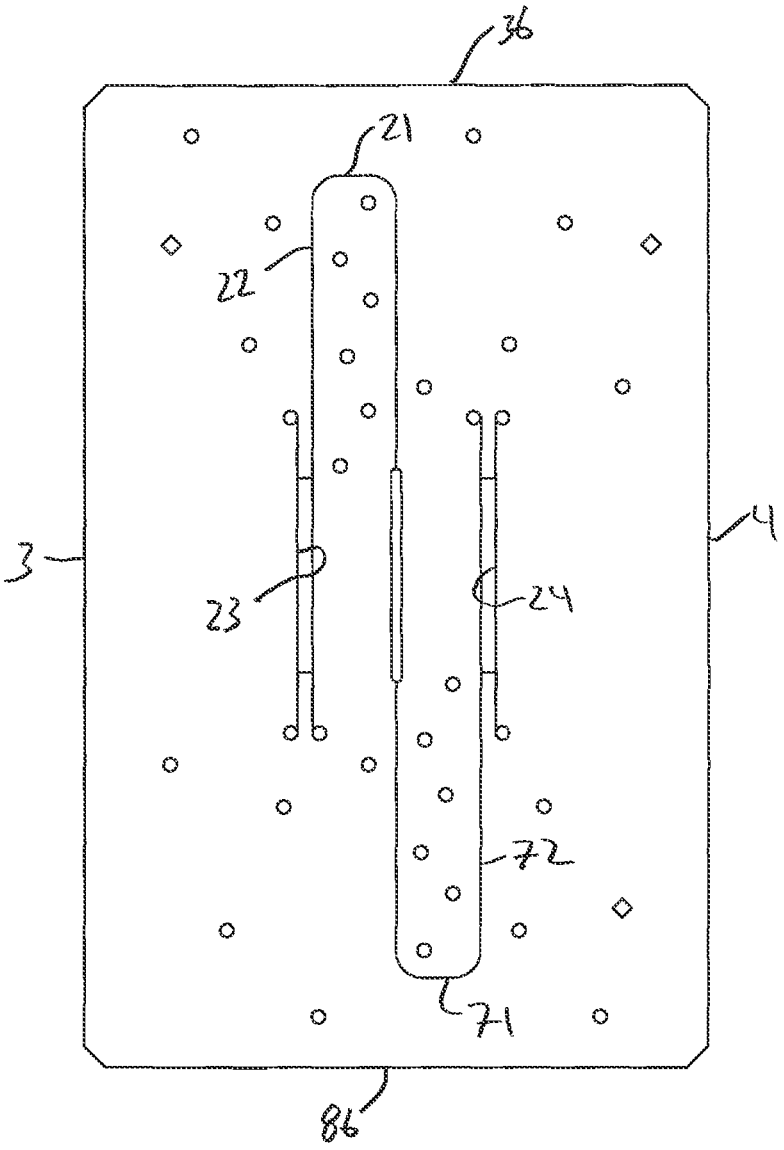
FIG. 41 is a plan view of the sheet metal blank of the connector of FIG. 36.
Figure 42:
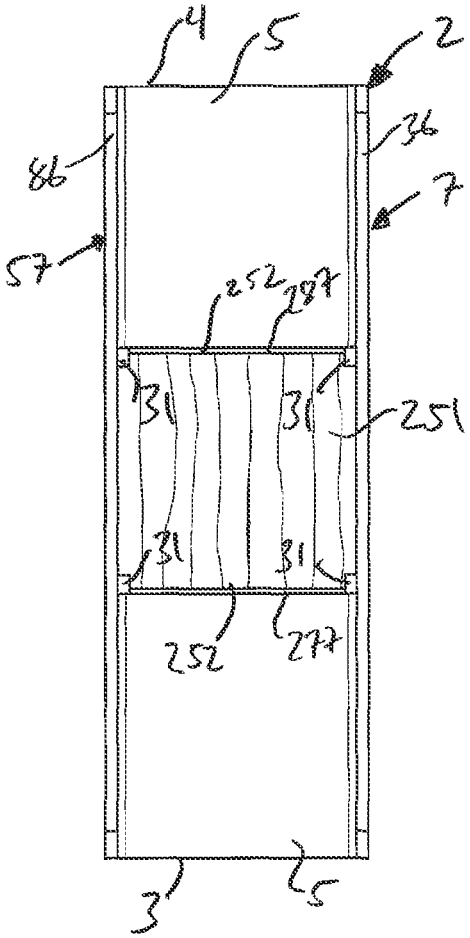
FIG. 42 is a top plan view of the connector and post of FIG. 36.

As shown in FIGS. 30, 35, 36 and 42, the projecting tabs 31 that are able to interface with the end face 351 of the supporting member 200 can be provided along the first longitudinally extending edge 6 of the connector 2 and along the second longitudinally extending edge 56 of the connector 2. As shown in FIG. 37, in the embodiment shown in FIGS. 36-42, the one or more projecting tabs 31 that are able to interface with the end face 251 of the supporting member 200 can be moved out of interfacing engagement with the end face 251 of the supporting member 200 when the supported member 100 is received by the connector 2, such that the bottom surface 101 of the supported member 100 rests directly on the end face 251 of the supporting member 200. Preferably the projecting tabs 31 are cut and bent from the first and second side walls 7 and 57, and the edges of the projecting tabs 31 interface with the end face 251 of the supporting member. When the supported member is inserted between first and second side walls 6 and 56, during the formation of the connection, and the supported member 100 is set on the web 5, the first and second side surfaces 107 and 157 of the supported member 100 push the projecting tabs 31 out of interfacing engagement with the end face 251 of the supported member 200.

Figure 30:
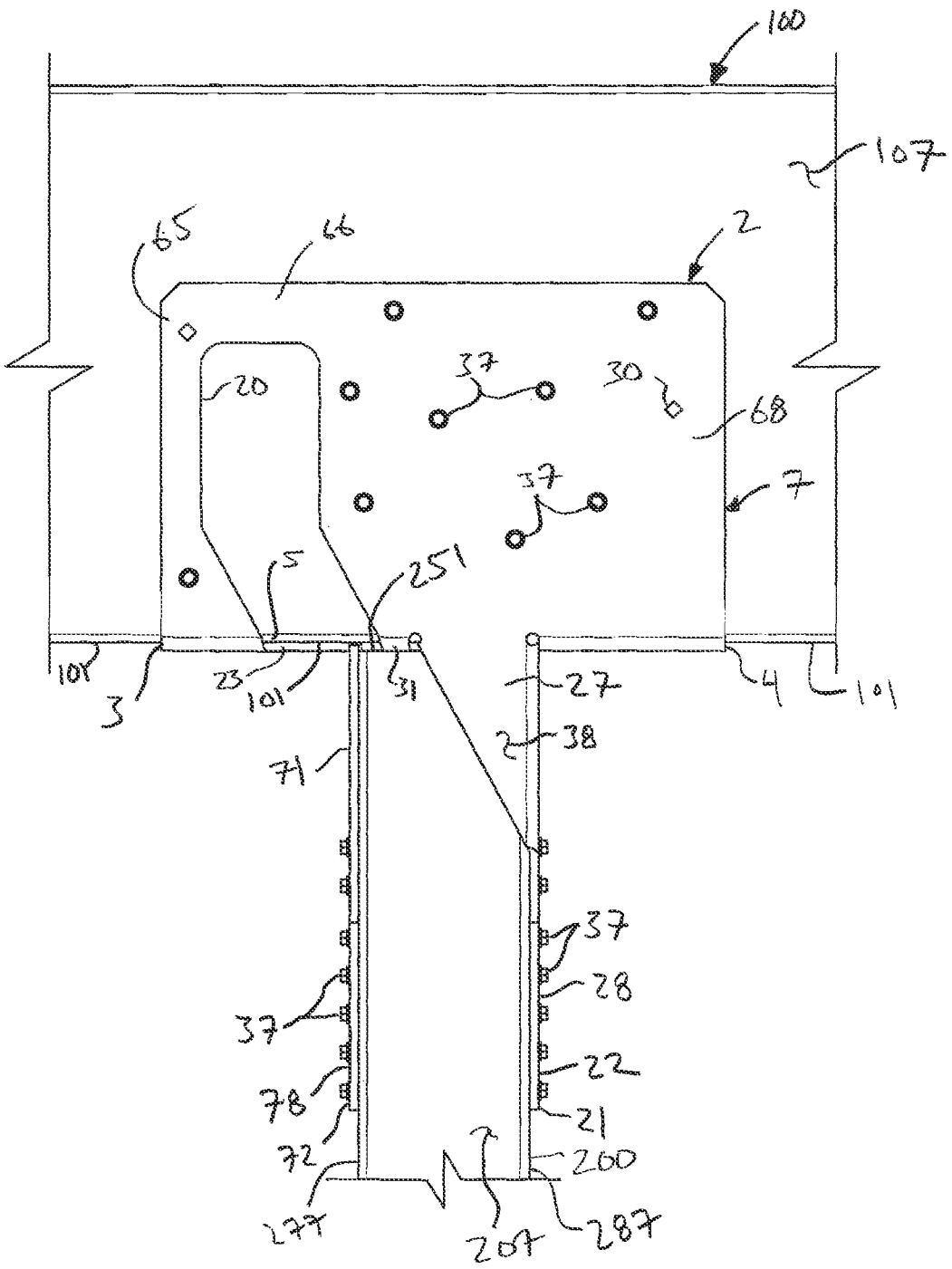
FIG. 30 is a front elevation view of the connection of the present invention made with the connector of FIG. 29.
Figure 31:
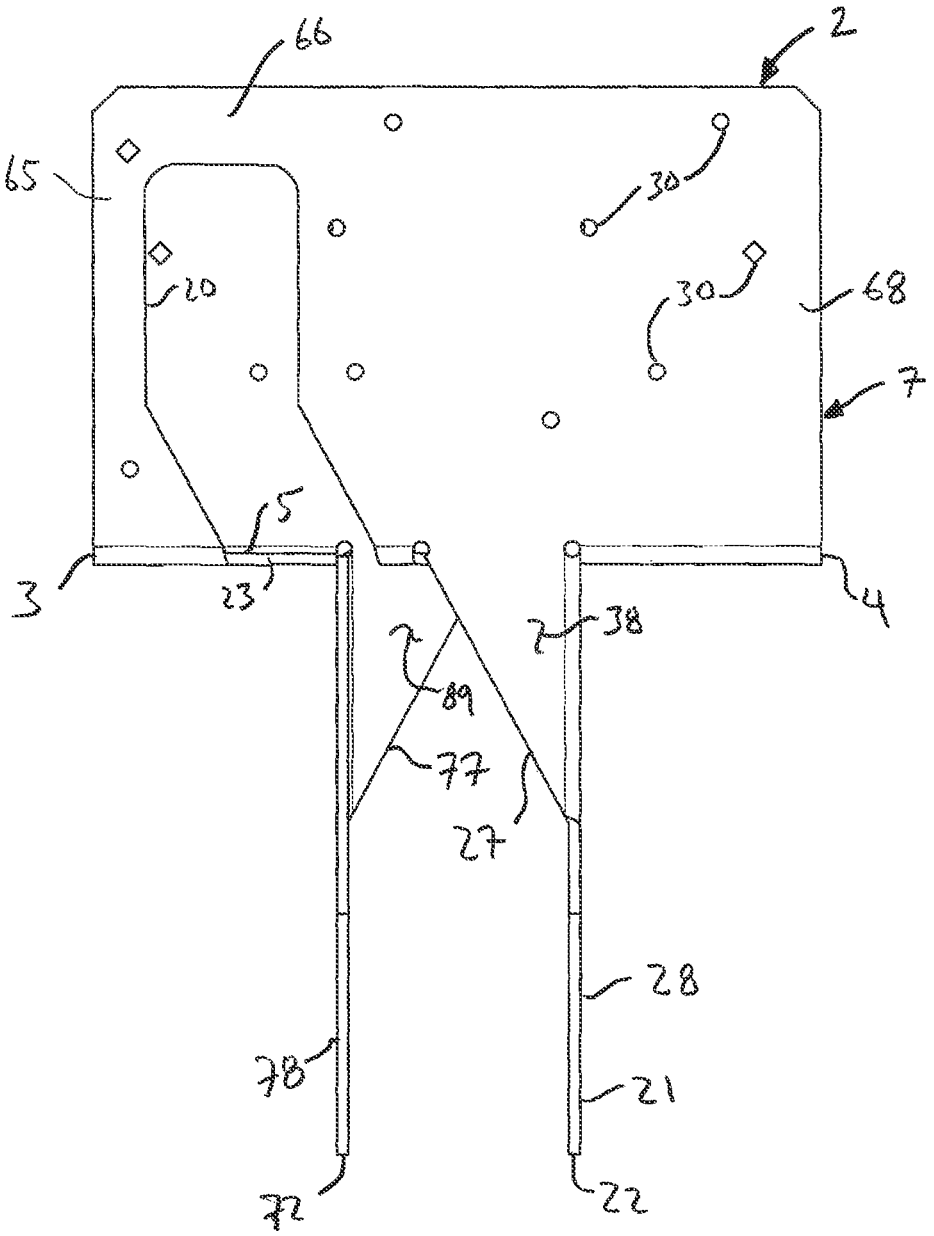
FIG. 31 is a front elevation view of the connector of FIG. 29.
Figure 32:
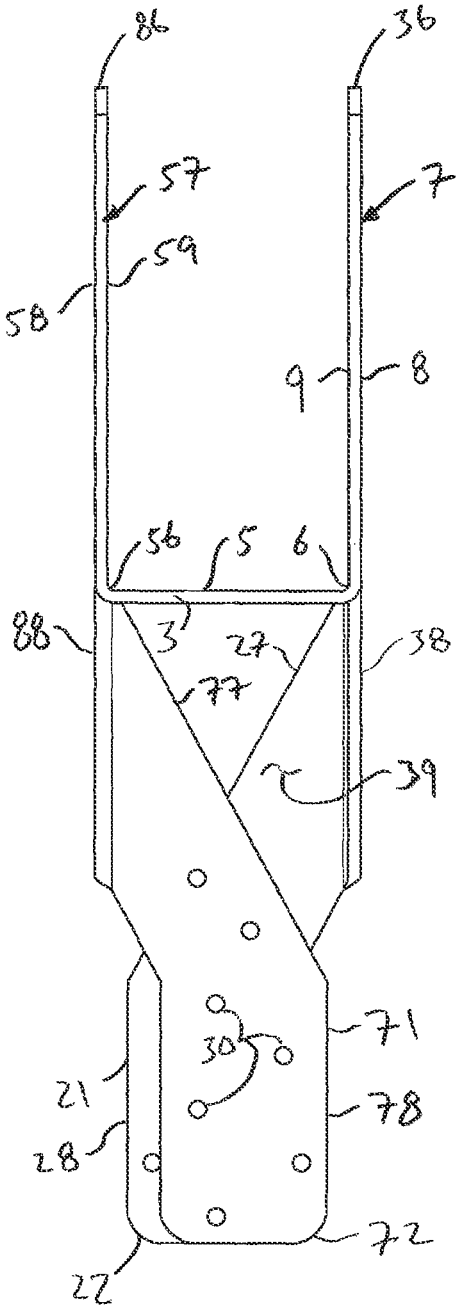
FIG. 32 is a side elevation view of the connector of FIG. 29.

As shown in FIGS. 29-33, the first and second attachment legs 21 and 71 can be formed with upper planar portions 27 and 77 and lower angled portions 28 and 78. The lower angled portions 77 and 78 preferably wrap around the supporting member 200, and are preferably set orthogonally to the upper planar portions 27 and 28. The upper planar portion 27 of the first attachment leg 21 projects from, is integrally joined to, and is preferably co-planar with the first wall 7. The upper planar portion 77 of the second attachment leg 71 projects from, is integrally joined to, and is, preferably, at least partially co-planar with the second wall 57. The post 200 is preferably formed with first and second opposed planar side surfaces 207 and 257, portions of which are in registration with the inner faces 39 and 89 of the upper planar portions 27 and 77 of the first and second attachment legs 21 and 71 when the connection 1 is made. First and second opposed planar side surfaces 207 and 257 of the supporting member 200 are preferably in parallel relation to the first and second side walls 7 and 57 of the connector 2 and the first and second side surfaces 107 and 157 of the supported member 100. The supporting member or post 200 is also preferably formed with third and fourth opposed planar side surfaces 277 and 287 which are orthogonally disposed with respect to the first and second opposed planar side surfaces 207 and 257. Portions of third and fourth opposed planar side surfaces 277 and 287 are in registration with the inner faces 39 and 89 of the lower angled portions 28 and 78 of the first and second attachment legs 21 and 71, respectively, when the connection is made. As shown in FIG. 30, preferably the lower angled portions 28 and 78 of the first and second attachment legs 21 and 71 are connected to the third and fourth opposed planar side surfaces 277 and 287 with fasteners 37.

Figure 33:
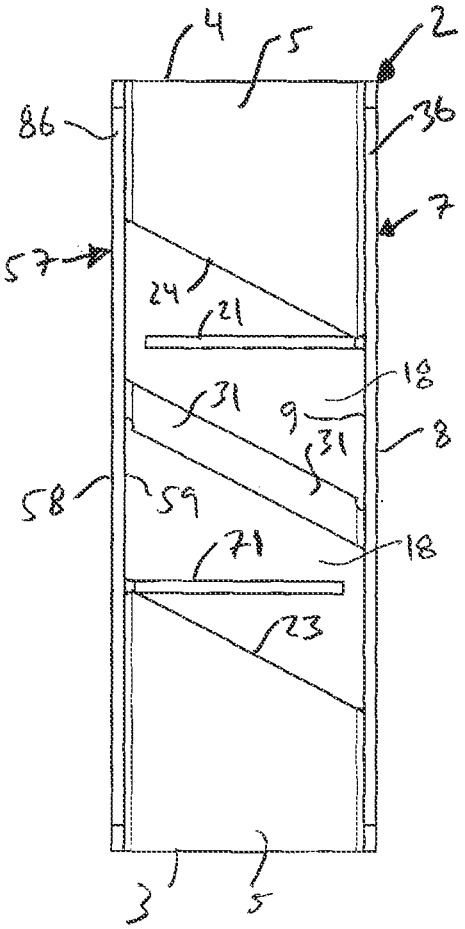
FIG. 33 is a top plan view of the connector of FIG. 29.
Figure 34:
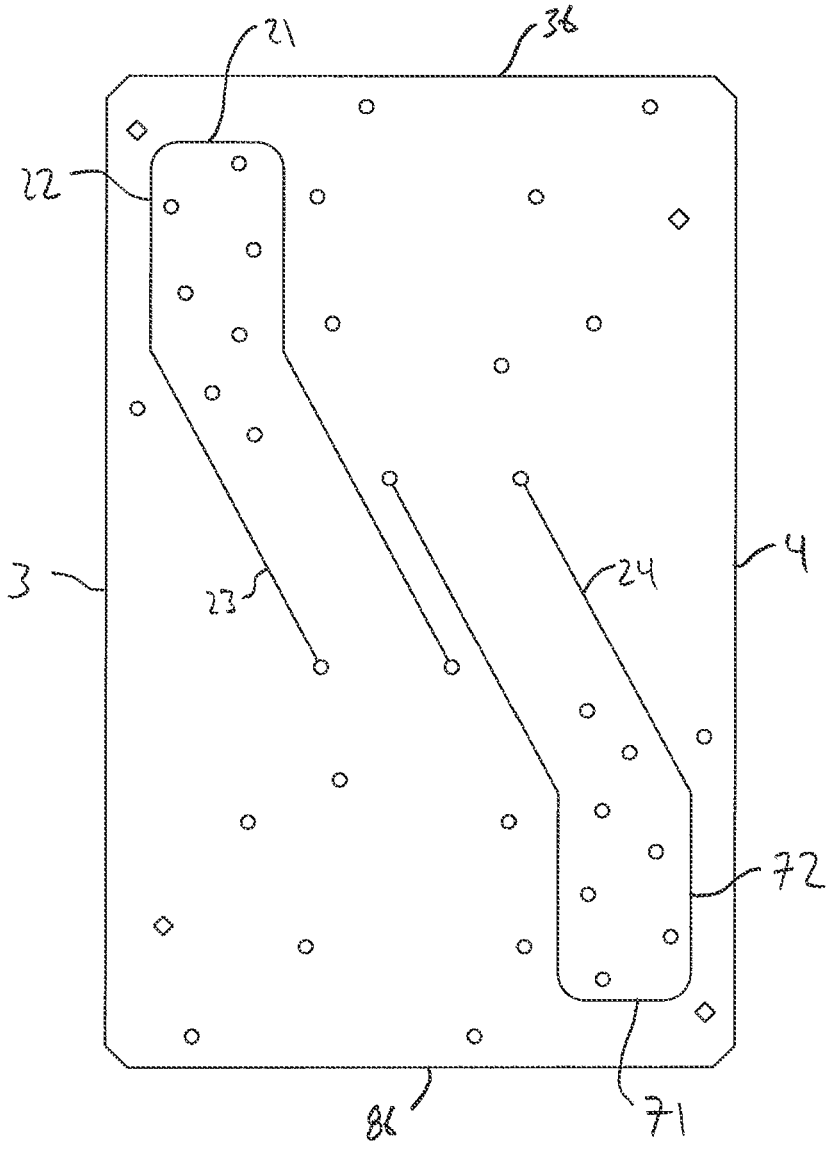
FIG. 34 is a plan view of the sheet metal blank of the connector of FIG. 29.
Figure 35:
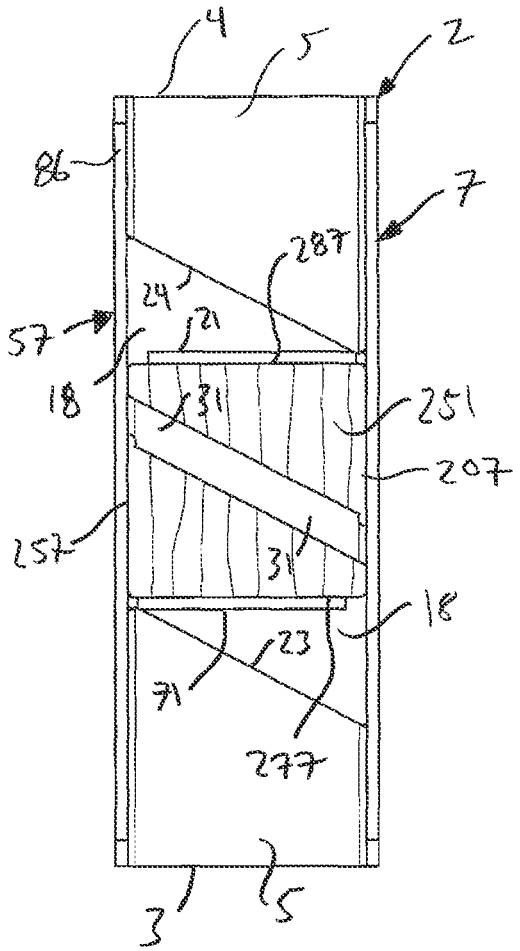
FIG. 35 is a top plan view of the connector and post of FIG. 29.
Figure 36:
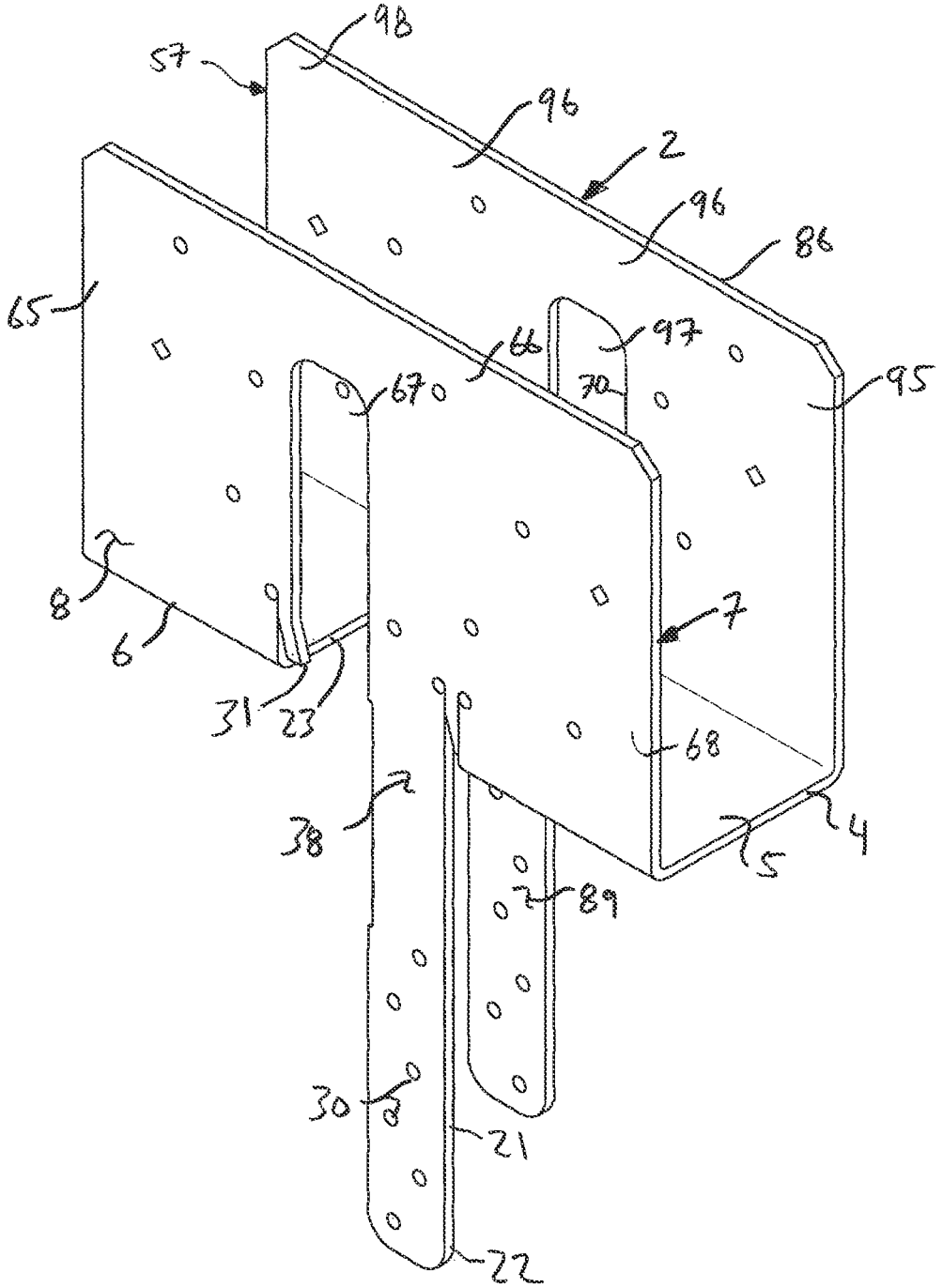
FIG. 36 is a perspective view of an alternate connector of the present invention.

As is also shown in FIGS. 33, 34 and 35, the projecting tabs 31 from the longitudinally extending edges 6 and 56 can extend towards and be integrally connected to each other.

We claim:

1. A connection between a supported member and a supporting member, comprising:

a. said supported member having a substantially planar bottom surface;

b. said supporting member having a substantially planar end face in close proximity to the substantially planar bottom surface of said supported member;

c. a connector fastened to said supported member and said supporting member, said connector having a first opposed end, a second opposed end and a web, one of said first and second ends being removed from the end face of the supporting member, the web having first and second longitudinally extending edges running between the first and second ends, with first and second walls connected to the first and second longitudinally extending edges, the first and second walls extending longitudinally along the first and second longitudinally extending edges and upwardly therefrom to first and second top edges, the first and second walls receiving the supported member, the connector having one or more central apertures in the web, the web having a first central edge that borders one of the one or more central apertures and lies nearer to the first end of the connector than the second end of the connector, the web having a second central edge that borders one of the one or more central apertures and lies nearer to the second end of the connector than the first end of the connector, the connector also having first and second attachment legs formed from material removed from the web to create the one or more central apertures, the first and second attachment legs extend from the first and second walls respectively and receive the supporting member there between, wherein, d. the supporting member is formed with first and second opposed planar side surfaces which are in parallel relation to the first and second side walls of the connector;

e. the first and second attachment legs have upper planar portions, wherein the upper planar portion of the first attachment leg projects from and is co-planar with the first wall, the upper planar portion of the second attachment leg projects from and is co-planar with the second wall, such that at least a portion of the upper planar portion of the first attachment leg interfaces with the first opposed planar side surface of the supporting member and such that at least a portion of the upper planar portion of the second attachment leg interfaces with the second opposed planar side surface of the supporting member;

f. at least one of the one or more central apertures traverses the first longitudinally extending edge of the web to enter the first wall, forming a notch in the first wall, and g. at least one of the one or more central apertures traverses the second longitudinally extending edge of the web to enter the second wall, forming a notch in the second wall, and wherein, h. the first attachment leg has an extended portion made from material from the notch in the second wall, and the second attachment leg has an extended portion made from material from the notch in the first wall.

2. The connection of claim 1, wherein:

a. along the first central edge of the web and between the longitudinally extending edges of the web, the first central edge angles away from the second end and toward the first end of the connector where the first attachment leg connects to the first wall, and wherein, b. along the second central edge that borders the web and between the longitudinally extending edges of the web the second central edge angles away from the first end and toward the second end of the connector where the second attachment leg connects to the second wall.

3. The connection of claim 2, wherein:

a. the supporting member is also formed with third and fourth opposed planar side surfaces which are orthogonally disposed with respect to the opposed planar side surfaces, and b. the first and second attachment legs have lower angled portions, wherein the lower angled portions of the first and second attachment legs are disposed orthogonally to the upper planar portions of the first and second attachment legs, such that at least a portion of the lower planar portion of the first attachment leg interfaces with the third opposed planar side surface of the supporting member, and such that at least a portion of the lower planar portion of the second attachment leg interfaces with the fourth opposed planar side surface of the supporting member.

4. The connection of claim 3, wherein:

there are two central apertures.

5. The connection of claim 2, wherein:

only a portion of each of the first and second central edges between the longitudinally extending edges of the walls angles away from the opposed end of the connector.

6. The connection of claim 5, wherein:

a. the supporting member is also formed with third and fourth opposed planar side surfaces which are orthogonally disposed with respect to the opposed planar side surfaces, and b. the first and second attachment legs have lower angled portions, wherein the lower angled portions of the first and second attachment legs are disposed orthogonally to the upper planar portions of the first and second attachment legs, such that at least a portion of the lower planar portion of the first attachment leg interfaces with the third opposed planar side surface of the supporting member, and such that at least a portion of the lower planar portion of the second attachment leg interfaces with the fourth opposed planar side surface of the supporting member.

7. The connection of claim 6, wherein:

there are two central apertures.

8. The connection of claim 6, wherein:

a. the notch in the first wall creates a first end portion and a second end portion in the first wall that are separated by the notch in the first wall and are connected by a bridge portion that lies above the notch in the first wall, with the bridge portion spaced substantially away from the first longitudinally extending edge, and wherein, b. the notch in second wall creates a first end portion and a second end portion in the second wall that are separated by the notch in the second wall and are connected by a bridge portion that lies above the notch in the second wall, with the bridge portion spaced substantially away from the second longitudinally extending edge.

9. The connection of claim 2, wherein:

a. the notch in the first wall creates a first end portion and a second end portion in the first wall that are separated by the notch in the first wall and are connected by a bridge portion that lies above the notch in the first wall, with the bridge portion spaced substantially away from the first longitudinally extending edge, and wherein, b. the notch in second wall creates a first end portion and a second end portion in the second wall that are separated by the notch in the second wall and are connected by a bridge portion that lies above the notch in the second wall, with the bridge portion spaced substantially away from the second longitudinally extending edge.

10. The connection of claim 1, wherein:

a. the supporting member is also formed with third and fourth opposed planar side surfaces which are orthogonally disposed with respect to the opposed planar side surfaces, and b. the first and second attachment legs have lower angled portions, wherein the lower angled portions of the first and second attachment legs are disposed orthogonally to the upper planar portions of the first and second attachment legs, such that at least a portion of the lower planar portion of the first attachment leg interfaces with the third opposed planar side surface of the supporting member, and such that at least a portion of the lower planar portion of the second attachment leg interfaces with the fourth opposed planar side surface of the supporting member.

11. The connection of claim 10, wherein:

there are two central apertures.

12. The connection of claim 11, wherein:

a. along the first central edge of the web and between the longitudinally extending edges of the web, the first central edge angles away from the second end and toward the first end of the connector where the first attachment leg connects to the first wall, and wherein, b. along the second central edge that borders the web and between the longitudinally extending edges of the web the second central edge angles away from the first end and toward the second end of the connector where the second attachment leg connects to the second wall.

13. The connection of claim 1, wherein:

a. the notch in the first wall creates a first end portion and a second end portion in the first wall that are separated by the notch in the first wall and are connected by a bridge portion that lies above the notch in the first wall, with the bridge portion spaced substantially away from the first longitudinally extending edge, and wherein, b. the notch in second wall creates a first end portion and a second end portion in the second wall that are separated by the notch in the second wall and are connected by a bridge portion that lies above the notch in the second wall, with the bridge portion spaced substantially away from the second longitudinally extending edge.

* * * * *